US010823413B2

(12) United States Patent
Harding

(10) Patent No.: US 10,823,413 B2
(45) Date of Patent: Nov. 3, 2020

(54) COMBUSTION CHAMBER ASSEMBLY AND A COMBUSTION CHAMBER SEGMENT

(71) Applicant: ROLLS-ROYCE plc, London (GB)

(72) Inventor: Stephen C Harding, Derby (GB)

(73) Assignee: ROLLS-ROYCE plc, London (GB)

( * ) Notice: Subject to any disclaimer, the term of this patent is extended or adjusted under 35 U.S.C. 154(b) by 218 days.

(21) Appl. No.: 15/658,863

(22) Filed: Jul. 25, 2017

(65) Prior Publication Data

US 2018/0031238 A1 Feb. 1, 2018

(30) Foreign Application Priority Data

Aug. 1, 2016 (GB) ..... 1613208.6

(51) Int. Cl.
*F23R 3/00* (2006.01)
*F23R 3/60* (2006.01)
(Continued)

(52) U.S. Cl.
CPC ..... *F23R 3/002* (2013.01); *F23R 3/005* (2013.01); *F23R 3/007* (2013.01); *F23R 3/04* (2013.01);
(Continued)

(58) Field of Classification Search
CPC ..... F23R 3/002; F23R 3/005; F23R 3/007; F23R 3/04; F23R 3/26; F23R 3/50;
(Continued)

(56) References Cited

U.S. PATENT DOCUMENTS 4,339,925 A 7/1982 Eggmann et al.
5,647,202 A 7/1997 Althaus
(Continued)

FOREIGN PATENT DOCUMENTS

EP 1 098 141 A1 5/2001
EP 2 518 408 A2 10/2012
(Continued)

OTHER PUBLICATIONS

Dec. 29, 2016 Search Report issued in British Patent Application No. 1613208.6.
(Continued)

*Primary Examiner* — Arun Goyal
*Assistant Examiner* — Henry Ng
(74) *Attorney, Agent, or Firm* — Oliff PLC

(57) ABSTRACT

A combustion chamber assembly comprises a combustion chamber and a plurality of nozzle guide vanes. Each nozzle guide vane comprises an inner platform, an outer platform and an aerofoil. The combustion chamber comprises an annular wall which includes at least one box like structure. An outer wall of each box has a plurality of apertures for the supply of coolant into the box and the interior of the box is divided into at least two regions. The upstream end of each box has apertures to supply coolant from a first region of its interior onto an inner surface of the inner wall to form a film of coolant. The downstream end of each box has apertures to supply coolant from a second region of its interior onto a surface of the inner or outer platform of the nozzle guide vanes to form a film of coolant.

21 Claims, 14 Drawing Sheets

(51) Int. Cl.
*F23R 3/50* (2006.01)
*F23R 3/04* (2006.01)
*F23R 3/26* (2006.01)

(52) U.S. Cl.
CPC ..... *F23R 3/26* (2013.01); *F23R 3/50* (2013.01); *F23R 3/60* (2013.01); *F23R 2900/03042* (2013.01); *F23R 2900/03044* (2013.01)

(58) Field of Classification Search
CPC ..... F23R 3/60; F23R 2900/03042; F23R 2900/03044
See application file for complete search history.

(56) References Cited

U.S. PATENT DOCUMENTS

| | | | | |
|---|---|---|---|---|
| 6,955,053 | B1 | 10/2005 | Chen et al. | |
| 2007/0275210 | A1* | 11/2007 | Heselhaus | F01D 5/288 428/116 |
| 2008/0104962 | A1* | 5/2008 | Patel | F01D 25/12 60/752 |
| 2010/0257863 | A1* | 10/2010 | Chila | F23R 3/005 60/755 |
| 2011/0126543 | A1* | 6/2011 | Kirsopp | F23R 3/002 60/742 |
| 2013/0031904 | A1* | 2/2013 | Garry | F23R 3/002 60/722 |
| 2013/0078582 | A1* | 3/2013 | Pidcock | F23R 3/04 431/12 |
| 2014/0030064 | A1* | 1/2014 | Bangerter | F23R 3/06 415/115 |
| 2016/0178199 | A1* | 6/2016 | Burd | F02C 7/18 60/782 |
| 2016/0252249 | A1* | 9/2016 | Erbas-Sen | F23R 3/002 60/752 |
| 2016/0273772 | A1* | 9/2016 | Cunha | F23R 3/06 |
| 2016/0327271 | A1* | 11/2016 | Sandoval | F23R 3/045 |

FOREIGN PATENT DOCUMENTS

| | | | |
|---|---|---|---|
| EP | 2574846 | A2 | 4/2013 |
| EP | 2775208 | A2 | 9/2014 |
| EP | 2913588 | A1 | 9/2015 |
| EP | 3054217 | A1 | 8/2016 |
| EP | 3054218 | A1 | 8/2016 |
| EP | 3073196 | A1 | 9/2016 |
| EP | 3098513 | A1 | 11/2016 |
| GB | 2086031 | A | 5/1982 |
| GB | 2 298 266 | A | 8/1996 |
| GB | 2 353 589 | A | 2/2001 |
| WO | 9714875 | A1 | 4/1997 |
| WO | 2015039074 | A1 | 3/2015 |
| WO | 2015/108584 | A2 | 7/2015 |
| WO | 2015/112220 | A2 | 7/2015 |
| WO | 2015/117139 | A1 | 8/2015 |
| WO | 2015/126501 | A2 | 8/2015 |

OTHER PUBLICATIONS

Nov. 22, 2017 Search Report issued in British Patent Application No. GB1711934.8.

* cited by examiner

COMBUSTION CHAMBER ASSEMBLY AND A COMBUSTION CHAMBER SEGMENT

The present disclosure concerns a combustion chamber assembly and a combustion chamber segment and in particular to a gas turbine engine combustion chamber assembly and a gas turbine engine combustion chamber segment.

Currently the combustion chambers of gas turbine engines use too much coolant, air, which may be used elsewhere in the gas turbine engine for other purposes, e.g. as additional coolant for the nozzle guide vanes to increase the working life of the nozzle guide vanes, used in the combustion chamber to reduce emissions of NOx and smoke, increase combustion efficiency or increase specific fuel consumption.

Currently a combustion chamber comprises a fabricated sheet metal outer wall, or a forged and machined outer wall, and an inner wall comprising a plurality of axially arranged rows of circumferentially arranged cast metal tiles. Each tile is secured to the outer wall by a number of threaded studs, nuts and washers.

Currently coolant, e.g. air, flows through the combustion chamber walls and removes heat from the combustion chamber walls by passing through impingement apertures in the outer wall and then by flowing through effusion apertures in the tiles to form a film of coolant on the inner surface of the tiles of the inner wall.

However, the coolant only has a short residence time within the combustion chamber wall and the amount of heat removal is limited by the short residence time.

The present disclosure seeks to provide a novel combustion chamber assembly which reduces or overcomes the above mentioned problem.

According to a first aspect of the disclosure there is provided a combustion chamber assembly comprising a combustion chamber and a plurality of nozzle guide vanes arranged at a downstream end of the combustion chamber, each nozzle guide vane comprising an inner platform, an outer platform and an aerofoil extending between the inner platform and the outer platform, the combustion chamber comprising an upstream end wall and at least one annular wall, the at least one annular wall comprising at least one box like structure, the at least one box like structure extending the full length of the combustion chamber, the at least one box like structure comprising an inner wall, an outer wall, an upstream end wall and a downstream end wall, the inner wall being spaced radially from the outer wall, the outer wall, the inner wall, the upstream end wall and the downstream end wall of the at least one box like structure comprising an integral structure, the interior of the box like structure being divided into at least two regions, the outer wall having a plurality of apertures for the supply of coolant into each of the at least two regions of the box like structure, the upstream end of the at least one box like structure having a plurality of apertures to supply coolant from a first upstream region of the interior of the box like structure and onto an inner surface of the inner wall to form a film of coolant, the first upstream region of the interior of the box like structure being configured to supply at least a portion of the coolant in an upstream direction to the plurality of apertures at the upstream end of the box like structure, the downstream end of the at least one box like structure having a plurality of apertures to supply coolant from a second downstream region of the interior of the box like structure and onto a surface of one of the inner platform and the outer platform to form a film of coolant, the second downstream region of the interior of the box like structure being configured to supply at least a portion of the coolant in a downstream direction to the plurality of apertures at the downstream end of the box like structure, the upstream end wall having a plurality of apertures to start a film of coolant on the inner surface of the inner wall and to draw coolant out of the first upstream region of the box like structure and the downstream end of the at least one box like structure having a second plurality of apertures to start a film of coolant onto a surface of one of the inner platform and the outer platform and to draw coolant out of the second downstream region of the box like structure, the inlets of the second plurality of apertures are in the outer wall of the at least one box like structure.

The plurality of apertures in the upstream end wall may be circumferentially spaced apart. Each aperture at the upstream end of the at least one box like structure may be arranged circumferentially between two apertures in the upstream end wall. Each aperture at the upstream end of the at least one box like structure may be aligned with an L shaped passage in the upstream end wall. Each L shaped passage may have a portion arranged parallel to and at the same radius as the apertures in the upstream end wall. The upstream end wall may have at least one row of circumferentially spaced apertures extending axially there-through, the at least one row of apertures being arranged at a radius less than, or greater than, but similar to the radius of the inner wall to start the film of coolant on the inner surface of the inner wall.

The plurality of second apertures at the downstream end of the at least one box like structure may be circumferentially spaced apart. Each aperture at the downstream end of the at least one box like structure may be arranged circumferentially between two of the second plurality of apertures at the downstream end of the at least one box like structure.

The at least one box like structure may have at least one third region, the at least one third region being positioned between the first upstream region and the second downstream region, each third region having a dilution port, the inner wall of the at least one box like structure having at least one passage adjacent the dilution port of each third region such that the flow of dilution air through the dilution port to draws coolant out of the at least one third region into the combustion chamber as additional mixing air.

The at least one box like structure may have a plurality of third regions, and each third region being positioned between the first region and the second region.

Each dilution port may comprise a double wall chute, the double wall chute having at least one chamber defined between an inner wall and an outer wall, the at least one passage extending through the chamber between the inner and outer walls of the double wall chute.

The interior of the at least one box like structure may have walls to divide the interior into regions.

The height of the interior of the box like structure in the first upstream region may be greatest at the upstream end. The height of the interior of the box like structure in the second downstream region may be greatest at the downstream end. The height of the interior of the box like structure in each third region may be greatest adjacent the dilution port.

Each region may have further walls to divide the region into ducts.

The further walls may extend axially, longitudinally within the first upstream region. The further walls may extend axially, longitudinally, within the second downstream region. The further walls may extend radially with respect to the dilution port within the third region. The dilution port may be arranged at the centre of the respective third region.

The cross-sectional area of each duct within the interior of the box like structure in the first upstream region may be greatest at the upstream end. The cross-sectional area of each duct within the interior of the box like structure in the second downstream region may be greatest at the downstream end. The cross-sectional area of each duct within the interior of the box like structure in each third region may be greatest adjacent the dilution port.

The number of apertures per unit length in the outer wall in the first upstream region may decrease from the downstream end to the upstream end. The number of apertures per unit length in the outer wall in the second downstream region may decrease from the upstream end to the downstream end. The number of apertures per unit length in the outer wall in each third region may decrease towards the dilution port.

A plurality of polyhedron shaped chambers being defined by a matrix of integral interconnected walls, the polyhedron shaped chambers being arranged in at least two layers between the outer wall and the inner wall, at least some of the polyhedron shaped chambers in each layer being fluidly interconnected to the polyhedron shaped chambers in each adjacent layer by apertures extending through the integral interconnected walls of the polyhedron shaped chambers for the flow of coolant there-between, at least some of the polyhedron shaped chambers in the layer adjacent the inner wall being fluidly interconnected to define a plurality of ducts extending over the outer surface of the inner wall, the ducts in the first upstream region extending longitudinally to the plurality of apertures at the upstream end of the box like structure and the ducts in the second downstream region extending longitudinally to the plurality of apertures at the downstream end of the box like structure.

A plurality of polyhedron shaped chambers being defined by a matrix of integral interconnected walls, the polyhedron shaped chambers being arranged in at least two layers between the outer wall and the inner wall, at least some of the polyhedron shaped chambers in each layer being fluidly interconnected to the polyhedron shaped chambers in each adjacent layer by apertures extending through the integral interconnected walls of the polyhedron shaped chambers for the flow of coolant there-between, at least some of the polyhedron shaped chambers in the layer remote from the inner wall being fluidly interconnected to define a plurality of ducts, the ducts in the first upstream region extending longitudinally to the plurality of apertures at the upstream end of the box like structure and the ducts in the second downstream region extending longitudinally to the plurality of apertures at the downstream end of the box like structure.

The ducts in at least one third region may extend to the at least one passage adjacent the dilution port.

The inner wall, the outer wall, the upstream end wall, the downstream end wall and the matrix of interconnected walls may comprise a monolithic piece.

The polyhedron shaped chambers may be parallelogram sided cuboid shaped chambers, square based pyramid shaped chambers, rhombic dodecahedron shaped chambers, elongated dodecahedron shaped chambers, truncated dodecahedron shaped chambers, spherical shaped chambers, spheroid shaped chambers or two types of polyhedron shaped chambers.

The upstream end of the at least one annular wall may have features to secure the at least one annular wall to an upstream ring structure and a downstream end of the at least one annular wall may have features to mount the at least one annular wall on a downstream ring structure.

The at least one annular wall may be manufactured by additive layer manufacture.

The at least one annular wall may be formed from a nickel base superalloy, a cobalt base superalloy or an iron base superalloy.

The at least one annular wall may comprise a plurality of box like structures. Each box like structure is a combustion chamber segment.

The upstream end of each combustion chamber segment may have features to secure the combustion chamber segment to an upstream ring structure and the downstream end of each combustion chamber segment having features to mount the combustion chamber segment on a downstream ring structure.

The combustion chamber segment may be formed from a nickel base superalloy, a cobalt base superalloy or an iron base superalloy.

The combustion chamber segment may be manufactured by additive layer manufacture.

The box like structure of the combustion chamber segment may have a first end wall extending from a first end of the outer wall to a first end of the inner wall, a second end wall extending from a second, opposite, end of the outer wall to a second, opposite, end of the inner wall, a first edge wall extending from a first edge of the outer wall to a first edge of the inner wall, a second edge wall extending from a second, opposite, edge of the outer wall to a second, opposite, edge of the inner wall to form the box like structure.

The combustion chamber segment may extend the full length of the at least one annular wall.

The combustion chamber may be an annular combustion chamber and the annular combustion chamber comprises a radially inner annular wall and a radially outer annular wall. The at least one annular wall may be a radially inner annular wall of an annular combustion chamber. The at least one annular wall may be a radially outer annular wall of an annular combustion chamber.

The combustion chamber may be a tubular combustion chamber. The at least one annular wall may be an annular wall of a tubular combustion chamber.

The combustion chamber may be a gas turbine engine combustion chamber.

The at least one annular wall may comprise a plurality of combustion chamber segments, each combustion chamber segment extending the full length of the at least one annular wall, each combustion chamber segment comprising a box like structure, each box like structure comprising a frame structure, an inner wall and an outer wall, the inner wall being spaced radially from the outer wall, the interior of each box like structure being divided into at least two regions, the outer wall of each combustion chamber segment having a plurality of apertures for the supply of coolant into each of the at least two regions of the box like structure, the upstream end of the each box like structure having a plurality of apertures to supply coolant from a first upstream region of the interior of the box like structure and onto an inner surface of the inner wall to form a film of coolant, the first upstream region of the interior of each box like structure being configured to supply at least a portion of the coolant in an upstream direction to the plurality of apertures at the upstream end of the box like structure, the downstream end of each box like structure having a plurality of apertures to supply coolant from a second downstream region of the interior of the box like structure and onto a surface of one of the inner platform and the outer platform to form a film of coolant, the second downstream region of the interior of each box like structure being configured to supply at least a portion of the coolant in a downstream direction to the plurality of apertures at the downstream end of the box like structure.

The frame structure, the inner wall and the outer wall may comprise a monolithic piece.

According to a second aspect of the disclosure there is provided a combustion chamber segment, the combustion chamber segment extending the full length of the combustion chamber, the combustion chamber segment comprising a box like structure, the box like structure comprising a frame structure, an inner wall and an outer wall, the inner wall being spaced from the outer wall, the frame structure, the inner wall and the outer wall comprises a monolithic piece, the interior of the box like structure being divided into at least two regions, the outer wall having a plurality of apertures for the supply of coolant into each of the at least two regions of the box like structure, the upstream end of the box like structure having a plurality of apertures to supply coolant from a first upstream region of the interior of the box like structure and onto an inner surface of the inner wall to form a film of coolant, the first upstream region of the interior of the box like structure being configured to supply at least a portion of the coolant in an upstream direction to the plurality of apertures at the upstream end of the box like structure, the downstream end of the at least one box like structure having a plurality of apertures to supply coolant from a second downstream region of the interior of the box like structure and onto a surface of one of the inner platform and the outer platform to form a film of coolant, the second downstream region of the interior of the box like structure being configured to supply at least a portion of the coolant in a downstream direction to the plurality of apertures at the downstream end of the box like structure.

The upstream end of the combustion chamber segment may have features to secure the combustion chamber segment to an upstream ring structure and a downstream end of the combustion chamber segment having features to mount the combustion chamber segment on a downstream ring structure.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
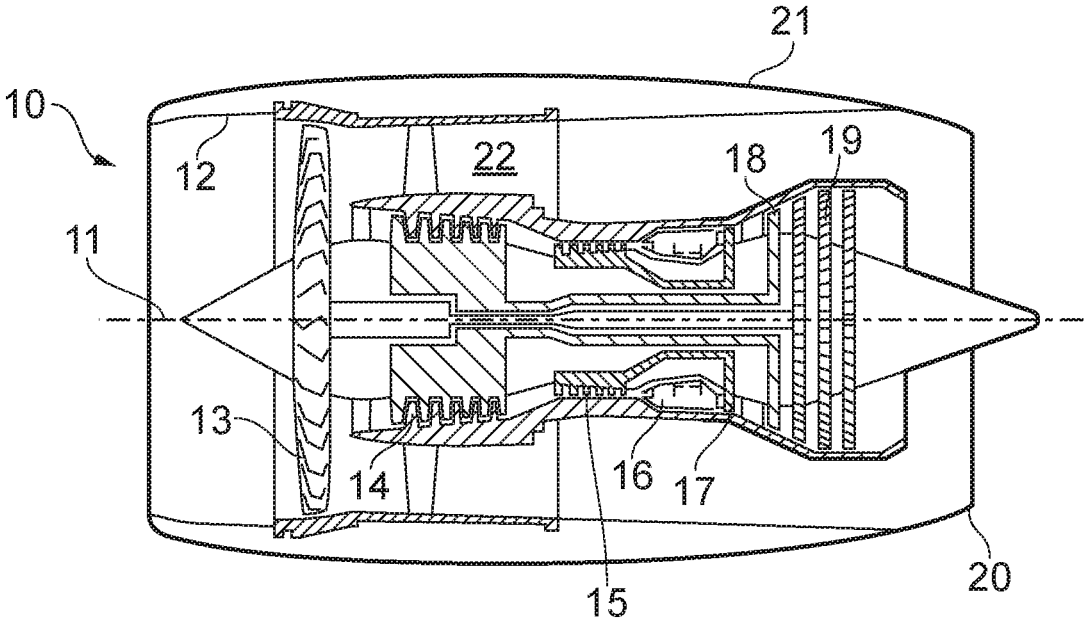
FIG. 1 is a sectional side view of a gas turbine engine.

With reference to FIG. 1, a turbofan gas turbine engine is generally indicated at 10, having a principal and rotational axis 11. The turbofan gas turbine engine 10 comprises, in axial flow series, an air intake 12, a propulsive fan 13, an intermediate pressure compressor 14, a high pressure compressor 15, combustion equipment 16, a high pressure turbine 17, an intermediate pressure turbine 18, a low pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high pressure compressor 15 is directed into the combustion equipment 16 where it is mixed with fuel and the mixture combusted. The resultant hot combustion products then expand through, and thereby drive the high, intermediate and low pressure turbines 17, 18, 19 before being exhausted through the nozzle 20 to provide additional propulsive thrust. The high pressure turbine 17, the intermediate pressure turbine 18 and the low pressure turbine 19 drive respectively the high pressure compressor 15, the intermediate pressure compressor 14 and the fan 13, each by suitable interconnecting shaft.

Figure 2:
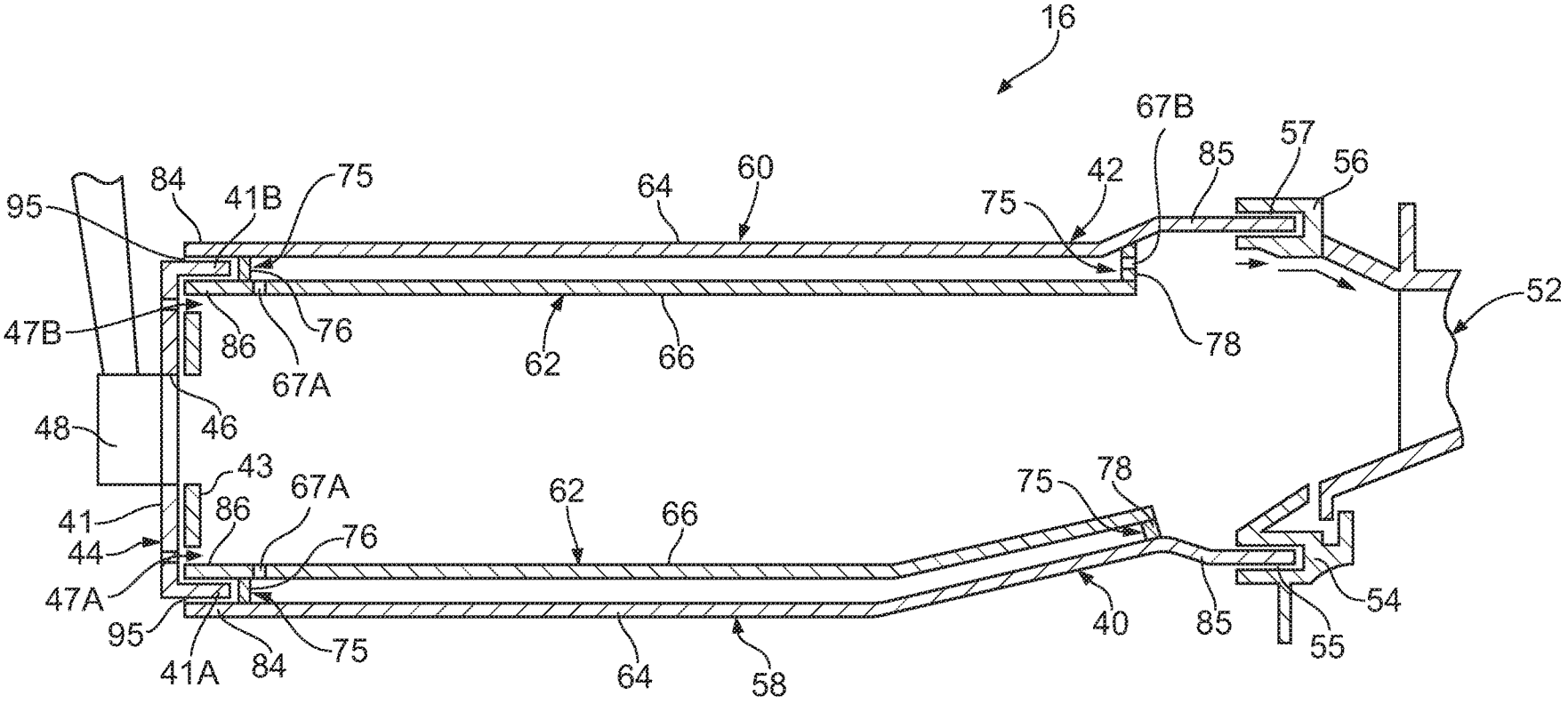
FIG. 2 is an enlarged sectional view through the combustion equipment of FIG. 1.

The combustion chamber 16, as shown more clearly in FIG. 2, is an annular combustion chamber and comprises a radially inner annular wall structure 40, a radially outer annular wall structure 42 and an upstream end wall structure 44. The upstream end wall structure 44 comprises an upstream end wall 41 and a plurality of circumferentially arranged heat shields 43 provided downstream of the upstream end wall 42 to protect the upstream end wall 41. The upstream end of the radially inner annular wall structure 40 is secured to the upstream end wall 41 and the upstream end of the radially outer annular wall structure 42 is secured to the upstream end wall 41. The upstream end wall structure 44 has a plurality of circumferentially spaced apertures 46 and each aperture 46 has a respective one of a plurality of fuel injectors 48 located therein. Each aperture 46 is provided in the upstream end wall 41 and a corresponding heat shield 43. The fuel injectors 48 are arranged to supply fuel into the annular combustion chamber 16 during operation of the gas turbine engine 10. A plurality of circumferentially arranged turbine nozzle guide vanes 52 are positioned axially downstream of the combustion chamber 16 and are arranged to direct the hot gases from the combustion chamber 16 into the high pressure turbine 17. The radially inner ends of the turbine nozzle guide vanes 52 are secured to a radially inner discharge nozzle 54 and the radially outer ends of the turbine nozzle guide vanes 52 are secured to a radially outer discharge nozzle 56.

The radially inner discharge nozzle 54 forms a radially inner downstream ring structure and the radially outer discharge nozzle 56 forms a radially outer downstream ring structure. The upstream end wall 41 has an inner annular flange 41A extending in an axially downstream direction therefrom and an outer annular flange 41B extending in an axially downstream direction therefrom. The upstream end wall 41 forms a radially inner upstream ring structure and a radially outer upstream ring structure. The radially inner annular wall structure 40 of the annular combustion chamber 16 and the radially outer annular wall structure 42 of the annular combustion chamber 16 comprise a plurality of circumferentially arranged combustion chamber segments 58 and 60 respectively. It is to be noted that the combustion chamber segments 58, 60 extend the full axial, longitudinal, length of the combustion chamber 16.

Figure 3:
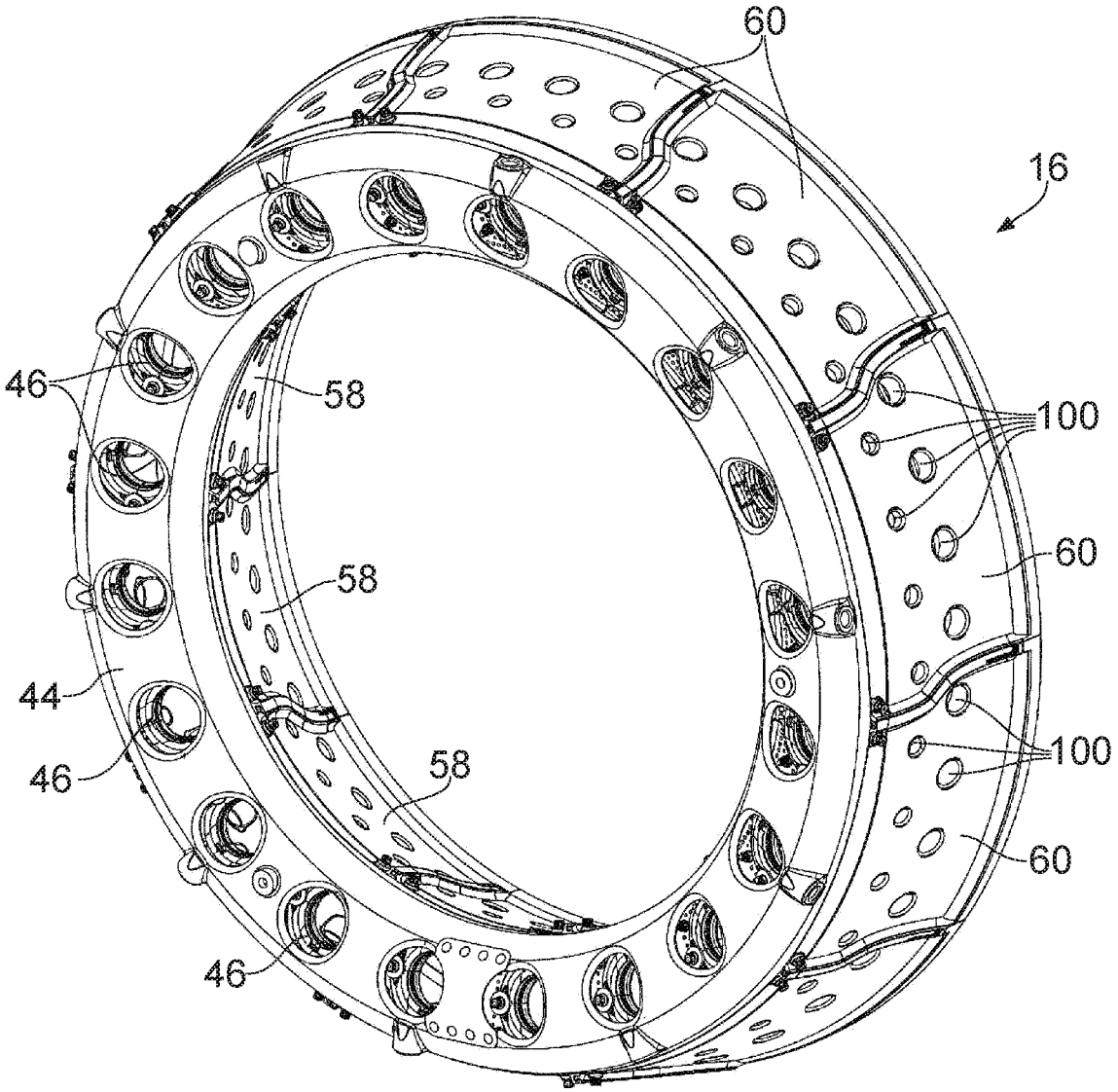
FIG. 3 is a perspective view of a combustion chamber assembly comprising a combustion chamber having combustion chamber segments according to the present disclosure.

The circumferential arrangement of combustion chamber segments 58 and 60 of the radially inner and radially outer annular wall structures 40 and 42 of the annular combustion chamber 16 are clearly shown in FIG. 3. In this example there are ten combustion chamber segments 58 and ten combustion chamber segments 60 and each combustion chamber segment 58 and 60 extends through an angle of 36°. Other suitable numbers of combustion chamber segments 58 and 60 may be used, e.g. two, three, four, five, six, eight or twelve, and the number of combustion chamber segments 58 may be the same as, or different to, the number of combustion chamber segments 60. It is preferred that each of the combustion chamber segments extends through the same angle, but it may be possible to arrange the combustion chamber segments to extend through different angles.

Each combustion chamber segment 58 and 60, as shown in FIGS. 4 to 8, comprises a box like structure 62 including an outer wall 64 and an inner wall 66 spaced from the outer wall 64. The outer wall 64 and the inner wall 66 are arcuate. FIGS. 4 to 8 show a combustion chamber segment 58 of the radially inner annular wall structure 40. The outer wall 64 has a plurality of apertures 69 for the supply of coolant into the box like structure 62 and the inner wall 66 has a plurality of apertures 67 for the supply of coolant out of the box like structure 62. A first edge 68 of the box like structure 62 has a first hook 70 extending from the outer wall 64 and away from the inner wall 66. The first hook 70 extends at least a portion of the axial, longitudinal, length of the box like structure 62 and the first hook 70 is arranged at a first radial distance from the outer wall 64. A second edge 72 of the box like structure 62 has a second hook 74 extending from the outer wall 64 and away from the inner wall 66. The second hook 74 extends at least a portion of the axial, longitudinal, length of the box like structure 62, the second hook 74 is arranged at a second radial distance from the outer wall 64 and the second radial distance is greater than the first radial distance. The first hook 70 of each combustion chamber segment 58, 60 engages the outer wall 64 at the second edge 72 of an adjacent combustion chamber segment 58, 60 and the second hook 74 of each combustion chamber segment 58, 60 engages the first hook 70 of an adjacent combustion chamber segment 58, 60 to form a seal and to distribute loads between the adjacent combustion chamber segments 58, 60 and to maintain a circular profile, shape, for the radially inner, or radially outer, annular wall structure 40 and 42 of the annular combustion chamber 16, e.g. to prevent dislocation of the combustion chamber segments 58, 60.

Thus, the first hook 70 of each combustion chamber segment 58, 60 contacts, abuts, or is in close proximity to the surface of the outer wall 64 at the second edge 72 of the adjacent combustion chamber segment 58, 60 and the second hook 74 of each combustion chamber segment 58, 60 contacts, abuts, or is in close proximity to the surface of the first hook 70 at the first edge 68 of the adjacent combustion chamber segment 58, 60. The first hook 70 of each combustion chamber segment 60 is arranged radially outwardly of the outer wall 64 at the second edge 72 of the adjacent combustion chamber segment 60 and the second hook 74 of each combustion chamber 60 is arranged radially outwardly of the first hook 70 at the first edge 68 of the adjacent combustion chamber segment 60. Similarly, the first hook 70 of each combustion chamber segment 58 is arranged radially inwardly of the outer wall 64 at the second edge 72 of the adjacent combustion chamber segment 58 and the second hook 74 of each combustion chamber 58 is arranged radially inwardly of the first hook 70 at the first edge 68 of the adjacent combustion chamber segment 58.

The upstream end of each combustion chamber segment 58, 60 is secured to the upstream ring structure and the downstream end of each combustion chamber segment is mounted on the downstream ring structure. Thus, the upstream end of each combustion chamber segment 58 is secured to the upstream ring structure, e.g. the upstream end wall, 41 and the downstream end of each combustion chamber segment 58 is mounted on the radially inner downstream ring structure, e.g. the radially inner discharge nozzle, 54. Similarly, the upstream end of each combustion chamber segment 60 is secured to the upstream ring structure, e.g. the upstream end wall, 41 and the downstream end of each combustion chamber segment 60 is mounted on the radially outer downstream ring structure, e.g. the radially outer discharge nozzle, 56. The first hook 70 extends the length of the box like structure 62 between a securing arrangement and a mounting arrangement and the second hook 74 also extends the length of the box like structure 62 between the securing arrangement and the mounting arrangement. The securing arrangement and the mounting arrangement are discussed further below.

However, it may be possible for the first hook to extend the full length of the box like structure and for the second hook to extend the full length of the box like structure. Alternatively, it may be possible for the first hook to extend only a part of the full length of the box like structure and for the second hook to extend only a part of the full length of the box like structure. Additionally, it may be possible for there to be a plurality of first hooks arranged along the length of the box like structure and for there to be a number of second hooks arranged along the length of the box like structure.

Figure 7:
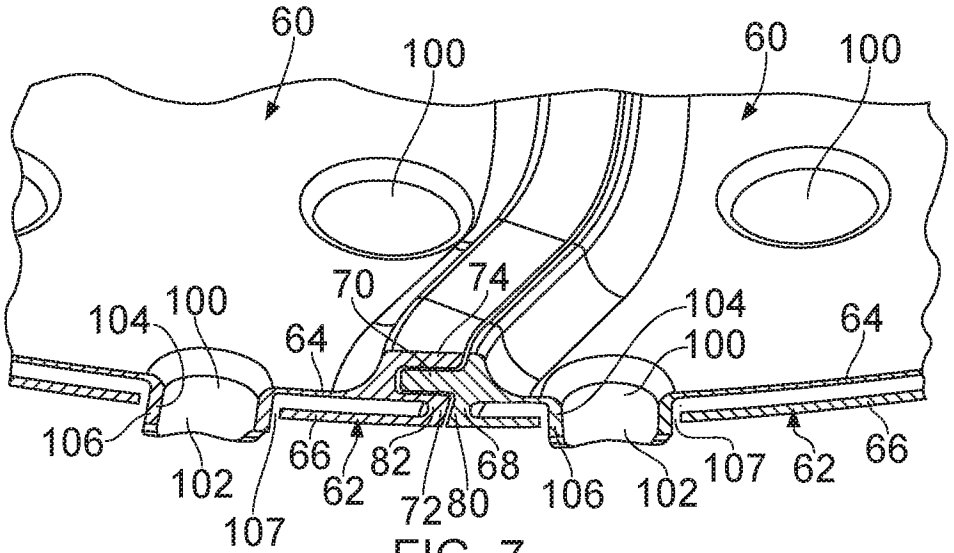
FIG. 7 is a cross-sectional view through portions of the edges of two adjacent combustion chamber segments shown in FIG. 6.
Figure 8:
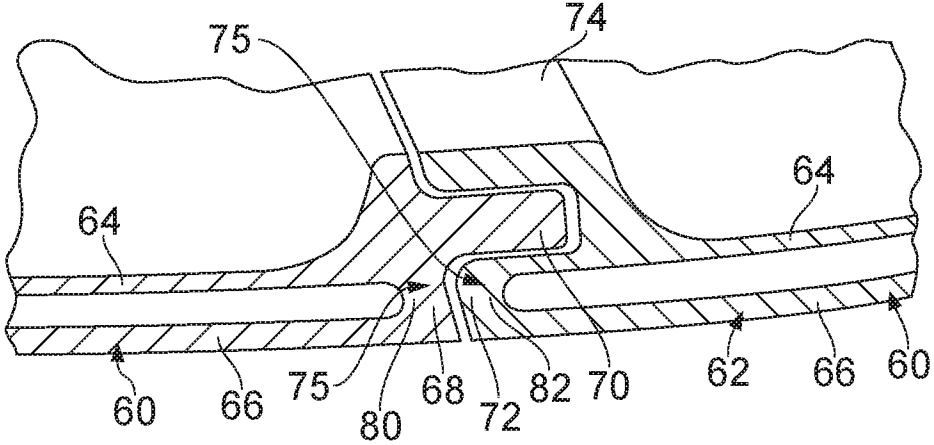
FIG. 8 is a further enlarged cross-sectional view through the portions of the edges of two adjacent combustion chamber segments shown in FIG. 7.
Figure 6:
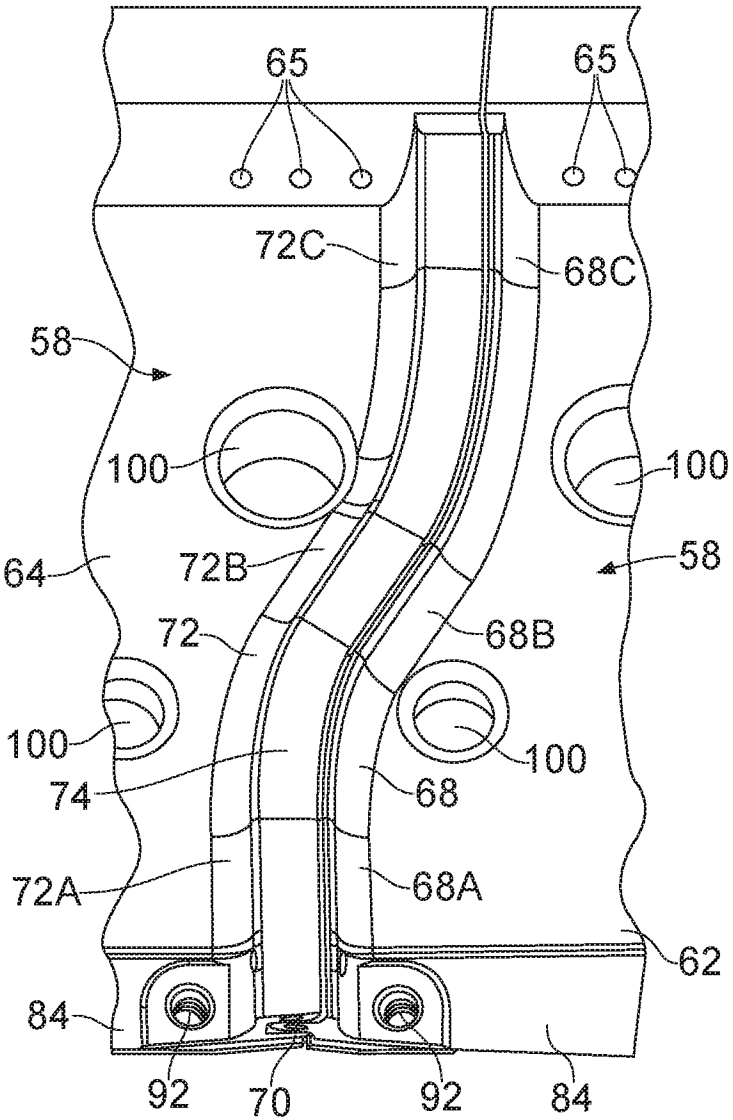
FIG. 6 is a further enlarged perspective view of a cold side of portions of the edges of two adjacent combustion chamber segments shown in FIG. 3.

The box like structure 62 of each combustion chamber segment 58, 60 has a first end wall 76 extending from a first, upstream, end of the outer wall 64 to a first, upstream, end of the inner wall 66, a second end wall 78 extending from a second, downstream and opposite, end of the outer wall 64 to a second, downstream and opposite, end of the inner wall 66, as shown in FIG. 2, a first edge wall 80 extending from a first circumferential edge of the outer wall 64 to a first circumferential edge of the inner wall 66, a second edge wall 82 extending from a second, opposite circumferential, edge of the outer wall 64 to a second, opposite circumferential, edge of the inner wall 66 to form the box like structure 62, as shown in FIGS. 7 and 8.

The first and second edges 68 and 72 of the combustion chamber segments 58, 60 are axially profiled, as shown in FIGS. 3 to 6. In this particular example first and second edges 68 and 72 of each combustion chamber segment 58, 60 has a first portion 68A, 72A extending with a purely axial component, a second portion 68B, 72B extending with axial and circumferential components and a third portion 68C, 72C extending with a purely axial component.

Alternatively, the first and second edges of the combustion chamber segments may extend with axial and circumferential components or the first and second edges of the combustion chamber segments may be S-shaped or W-shaped.

The box like structure 62 of each combustion chamber segment 58, 60 comprises a frame 75 and the frame 75 comprises the first and second end walls 76 and 78 and the first and second edge walls 80 and 82. The first and second end walls 76 and 78 and the first and second edge walls 80 and 82 are integral, e.g. one piece. The frame 75 of each combustion chamber segment 58, 60 is radially thicker, and stiffer, than the outer wall 64 and the inner wall 66 and the first and second end walls 76 and 78 and the first and second edge walls 80 and 82 are thicker axially and thicker circumferentially respectively than the radial thickness of the outer and inner walls 64 and 66 in order to carry loads and interface with adjacent combustion chamber segments 58, 60 and the upstream ring structure and the downstream ring structure. The frame 75 of each combustion chamber segment 58, 60 is arranged to carry the structural loads, the thermal loads, surge loads and flameout loads. The first hook 70 is provided on the first edge wall 80 and the second hook 74 is provided on the second edge wall 82. In other words the box like structure 62 of each combustion chamber segment 58, 60 comprises the frame 75 and portions of the outer and inner walls 64 and 66 extending axially, longitudinally, between the first and second end walls 76 and 78 and extending circumferentially, laterally, between the first and second edge walls 80 and 82 and the box like structure 62 is an integral structure, e.g. one piece structure or a monolithic structure.

The first, upstream, end of the outer wall 64 of each combustion chamber segment 58, 60 has a flange 84 and the flange 84 has at least one locally thicker region 88, each locally thicker region 88 of the outer wall 64 has an aperture 92 extending there-through. The first, upstream, end of the inner wall 66 has a flange 86 and the flange 86 has at least one locally thicker region 90, each locally thicker region 90 of the inner wall 66 has an aperture 94 extending there-through. The at least one locally thicker region 88 at the first end of the outer wall 64 is arranged such that the aperture 92 is aligned with the aperture 94 through the corresponding locally thicker region 90 of the inner wall 66 and an annular slot 95 is formed between the flange 84 of the first end of the outer wall 64 and the flange 86 of the first end of the inner wall 66. The flange 84 at the first end of the outer wall 64 and the flange 86 at the first end of the inner wall 66 of each combustion chamber segment 58, 60 have a plurality of locally thickened regions 88, 90 respectively and the locally thicker regions 88, 90 are spaced apart circumferentially, laterally, between the first and second edges 68, 70 of the outer and inner walls 64 and 66 of the combustion chamber segments 58, 60. The aperture 94 in the at least one, or each, locally thickened region 90 of the inner wall 66 of each combustion chamber segment 58, 60 is threaded.

Each combustion chamber segment 58, 60 is secured to the upstream end wall 41 by one or more bolts 96. Each combustion chamber segment 58 is positioned such that the inner annular flange 41A of the upstream end wall 41 is located radially between the flanges 84 and 86 at the upstream end of the combustion segment 58 and such that the apertures 92 and 94 in the flanges 84 and 86 are aligned with a corresponding one of a plurality of circumferentially spaced apertures 45A in the flange 41A of the upstream end wall 41. Bolts are inserted through the aligned apertures 92 and 45A and threaded into the apertures 94 to secure the combustion chamber segment 58 to the upstream end wall 41. Alternatively, rivets may be inserted through the aligned apertures 92 and 45A and the apertures 94 to secure the combustion chamber segment 58 to the upstream end wall 41. Similarly, each combustion chamber segment 60 is positioned such that the inner annular flange 41B of the upstream end wall 41 is located radially between the flanges 84 and 86 at the upstream end of the combustion segment 60 and such that the apertures 92 and 94 in the flanges 84 and 86 are aligned with a corresponding one of a plurality of circumferentially spaced apertures 45B in the flange 41B of the upstream end wall 41. Bolts are inserted through the aligned apertures 92 and 45A and threaded into the apertures 94 to secure the combustion chamber segment 60 to the upstream end wall 41. Alternatively, rivets may be inserted through the aligned apertures 92 and 45A and the apertures 94 to secure the combustion chamber segment 60 to the upstream end wall 41.

The second hook 74 of each combustion chamber segment 58, 60 forms a groove and the first hook 70 forms a tongue. The second hook 74 of each combustion chamber segment 58, 60 may form a dovetail shaped groove and the first hook 70 of each combustion chamber segment 58, 60 may form a dovetail shaped tongue.

Each combustion chamber segment 58 is mounted on the radially inner downstream ring structure, e.g. the radially inner discharge nozzle, 54. The second, downstream, end of the outer wall 64 of each combustion chamber segment 58 has a flange 85 and the flange 85 of each combustion chamber segment 58 is positioned in an annular slot 55 formed in the radially inner discharge nozzle 54, as shown in FIG. 2. Each combustion chamber segment 60 is mounted on the radially outer downstream ring structure, e.g. the radially outer discharge nozzle, 56. The second, downstream, end of the outer wall 64 of each combustion chamber segment 60 has a flange 85 and the flange 85 of each combustion chamber segment 60 is positioned in an annular slot 57 formed in the radially outer discharge nozzle 56, also shown in FIG. 2.

The outer wall 64 of each combustion chamber segment 58, 60 has at least one dilution aperture 100, the inner wall 66 of each combustion chamber segment 58, 60 has at least one dilution aperture 102 aligned with the corresponding dilution aperture 100 in the outer wall 64. At least one dilution wall 104 extends from the periphery of the corresponding dilution aperture 100 in the outer wall 64 to the periphery of the corresponding dilution aperture 102 in the inner wall 66. The inner wall 66 of each combustion chamber segment 58, 60 has at least one dilution chute 106, the at least one dilution chute 106 extends from the inner wall 66 in a radial direction away from the inner wall 66 and the outer wall 64 and each dilution chute 106 is aligned with a corresponding one of the dilution apertures 102 in the inner wall 66, as shown in FIGS. 4 to 7. In this example there are a plurality of dilution apertures 100, and corresponding dilution apertures 102, dilution walls 104 and dilution chutes 106. Each dilution chute 106 is thus a continuation of the corresponding dilution wall 104 which extends into the combustion chamber. The dilution apertures 100, dilution walls 104, dilution holes 102 and dilution chutes 106 form dilution ports to supply dilution air, or mixing air, from the exterior of the combustion chamber into the interior of the combustion chamber to mix with the combusting fuel and air within the combustion chamber as is well known to those skilled in the art.

Figure 4:
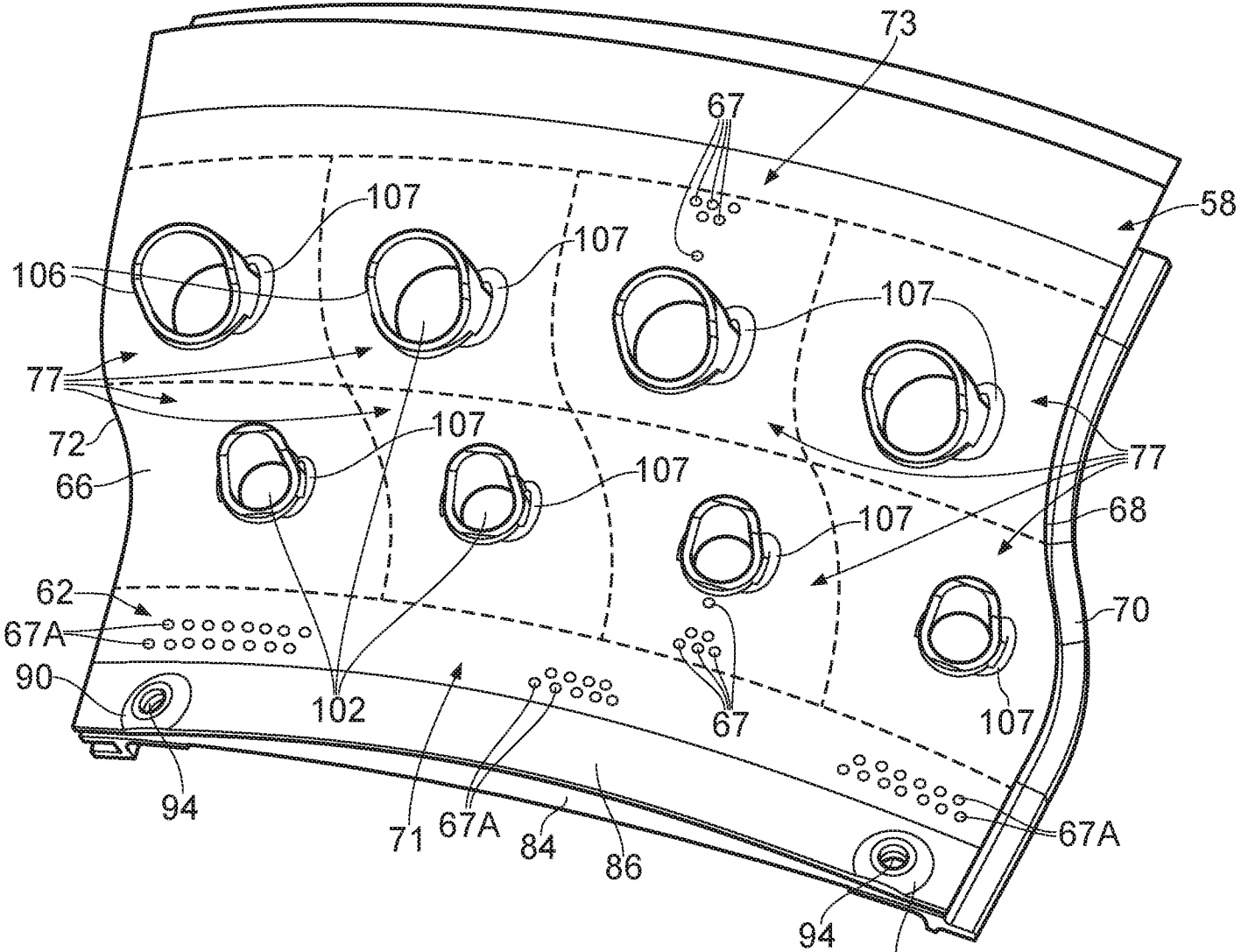
FIG. 4 is a further enlarged perspective view of a hot side of a combustion chamber segment shown in FIG. 3.
Figure 5:
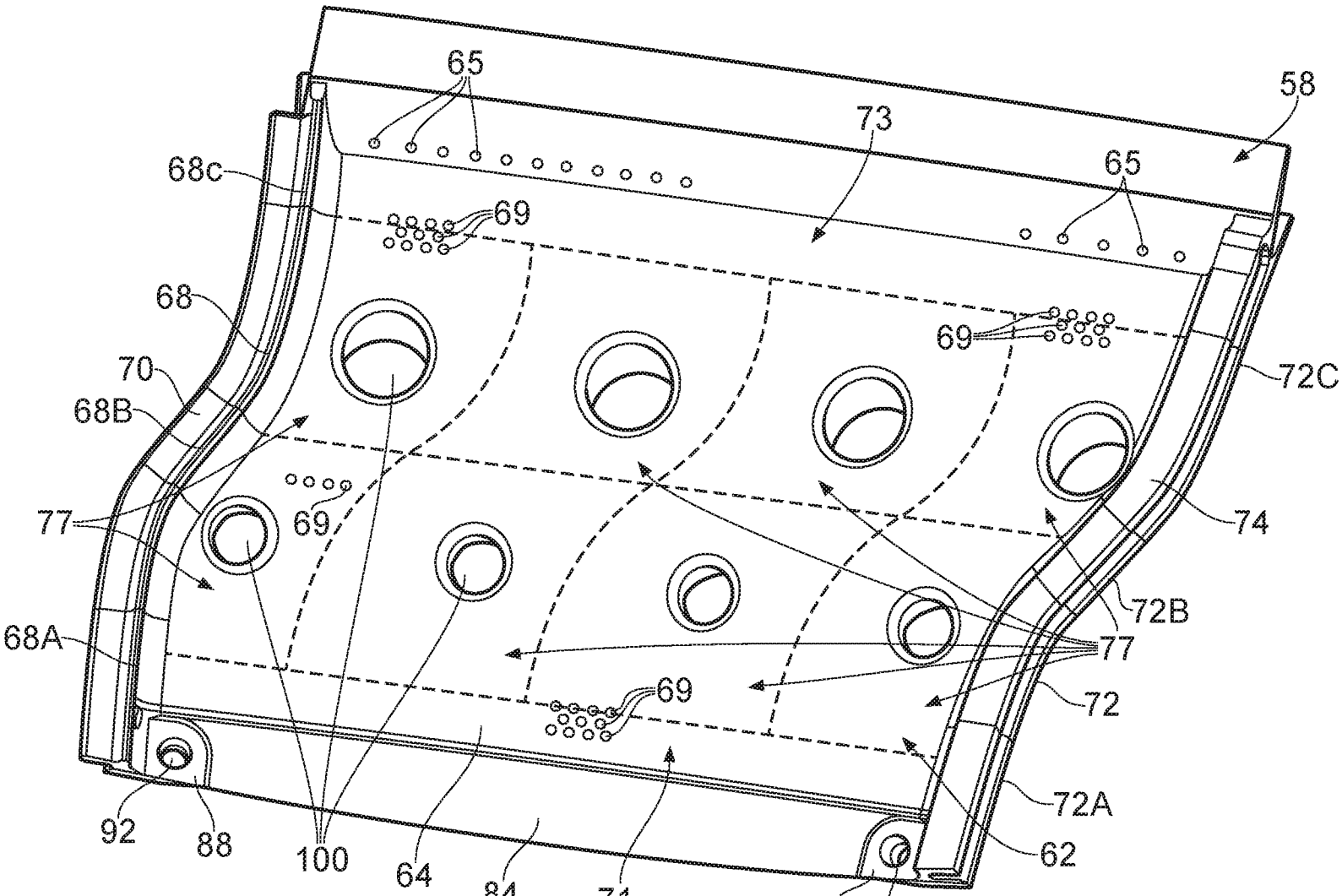
FIG. 5 is a further enlarged perspective view of a cold side of a combustion chamber segment shown in FIG. 3.

The interior of the box like structure of each combustion chamber segment 58, 60 of a rich burn combustion chamber is divided into a plurality of regions 71, 73 and 77, as shown by the dashed lines in FIGS. 4 and 5. A first region 71 of the interior of each combustion chamber segment 58, 60 is arranged at an upstream end of the combustion chamber segment 58, 60. A second region 73 of the interior of each combustion chamber segment 58, 60 is arranged at a downstream end of the combustion chamber segment 58, 60. A plurality of third regions 77 of the interior of each combustion chamber segment 58, 60 are arranged between the first region 71 and the second region 73 of the respective combustion chamber segment 58, 60 and each third region 77 is associated with a respective one of the dilution apertures 102 in the inner wall 66 and a corresponding one of the dilution apertures 100, dilution walls 104 and dilution chutes 106. The upstream end of the box like structure of each combustion chamber segment 58, 60 has a plurality of apertures 67A to supply coolant from the first region 71 of the interior of the box like structure and onto an inner surface of the inner wall 66 to form a film of coolant which flows in a downstream direction over the inner surface of the inner wall 66 of the combustion chamber segment 58, 60 to cool the inner wall 66 of the combustion chamber segment 58, 60. The downstream end of the box like structure of each combustion chamber segment 58 has a plurality of apertures 67B to supply coolant from the second region 73 of the interior of the box like structure and onto the radially outer surfaces of the inner platforms of the turbine nozzle guide vanes 52 to form a film of coolant which flows in a downstream direction over the radially outer surfaces of the inner platforms to cool the inner platforms of the turbine nozzle guide vanes 52. Similarly, the downstream end of the box like structure of each combustion chamber segment 60 has a plurality of apertures 67B to supply coolant from the second region 73 of the interior of the box like structure and onto the radially inner surfaces of the outer platforms of the turbine nozzle guide vanes 52 to form a film of coolant which flows in a downstream direction over the radially inner surfaces of the outer platforms to cool the outer platforms of the turbine nozzle guide vanes 52. Coolant is supplied from each of the third regions 77 of the interior of the box like structure of each combustion chamber segment 58, 60 into the combustion chamber through at least one passage 107 adjacent to the respective dilution aperture 102 and dilution chute 106 in the inner wall 66 of the combustion chamber segment 58, 60 and this coolant provides additional dilution air for the combustion process within the combustion chamber. The at least one passage 107 may be an annular passage, or a plurality of circumferentially spaced slots, arranged around the dilution chute 106. The flow of dilution air through each of the dilution ports as an ejector to draw, extract, the cooling air from within the respective third region 77 of the box like structure of each combustion chamber segment 58, 60 through the at least one passage 107 adjacent to the dilution port and into the combustion chamber. Each dilution port is arranged at the centre of the respective third region 77, but may be arranged at other locations. The coolant in region 71 flows in an upstream direction contrary to the direction of flow of hot gases within the combustion chamber 16 and the coolant in region 73 flows in a downstream direction in the same direction of flow of hot gases within the combustion chamber 16. The coolant in each region 77 flows towards the associated dilution port and this may be in an upstream direction, a downstream direction, a circumferential direction, a combination of upstream and circumferential directions of a combination of downstream and circumferential directions.

The upstream end wall structure 44 is provided with a plurality of apertures 47A extending through the upstream end wall 41 to provide a starter film of coolant over the inner surfaces of the combustion chamber segments 58 and a plurality of apertures 47B extending through the upstream end wall 41 to provide a starter film of coolant over the inner surfaces of the combustion chamber segments 60, as shown in FIG. 2. The apertures 47A are arranged as one or more rows of circumferentially spaced apertures and the apertures 47B are arranged as one or more rows of circumferentially spaced apertures. The apertures 47A and 47B direct the flow of coolant over the inner surfaces at the upstream end of the inner wall 66 of the combustion chamber segments 58, 60 and the flow of coolant from the apertures 47A and 47B acts as an ejector to draw the coolant from the regions 71 in the combustion chamber segments 58, 60, through the apertures 67A in the inner wall 66 of the combustion chamber segments 58, 60, no matter which arrangement is provided within the interior of the regions 71. The apertures 47A are arranged at a radius greater than but similar to the radius of the inner wall 66 of the combustion chamber segment 58 and the apertures 47B are arranged at a radius less than but similar to the radius of the inner wall 66 of the combustion chamber segments 60. The arrangement of the apertures 47A, 47B in the upstream end wall 41 and the apertures 67A in the inner wall 66 of the combustion chamber segments 58, 60 is discussed further below.

The downstream end of each combustion chamber segment 58 is provided with a plurality of apertures 65 extending there-through to provide a film of coolant over the radially outer surfaces of the radially inner platforms of the nozzle guide vanes 52 and the downstream end of each combustion chamber segment 60 is provided with a plurality of apertures 65 extending there-through to provide a film of coolant over the radially inner surfaces of the radially outer platforms of the nozzle guide vanes 52. The inlets of the apertures 65 are in the outer wall 64 of the combustion chamber segments 58, 60. The apertures 65 are arranged as one or more rows of circumferentially spaced apertures. The apertures 65 direct the flow of coolant over the inner surfaces at the downstream end of the inner wall 66 of the combustion chamber segments 58, 60 and the flow of coolant from the apertures 65 acts as an ejector to draw the coolant from the regions 73 in the combustion chamber segments 58, 60, through the apertures 67B at the downstream end of the combustion chamber segments 58, 60, no matter which arrangement is provided within the interior of the regions 73. The arrangement of the apertures 65 and the apertures 67B at the downstream end of the combustion chamber segments 58, 60 is discussed further below.

Figure 9:
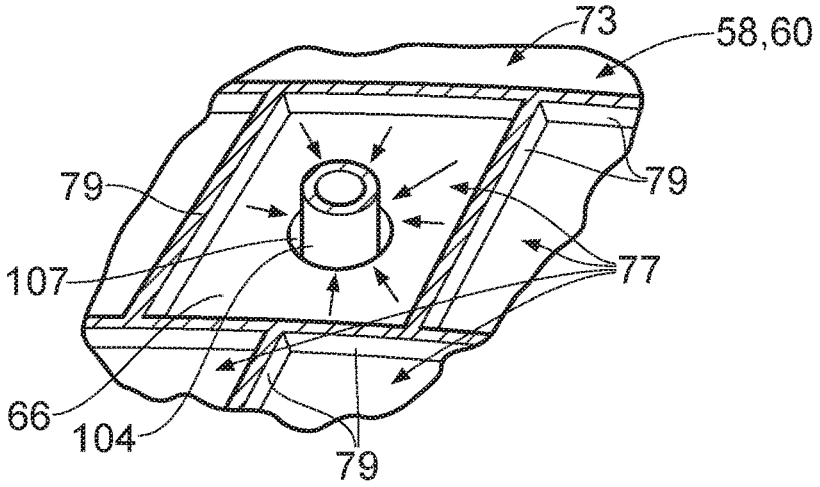
FIG. 9 is a cut away perspective view of a portion of a combustion chamber segment shown in FIG. 5.
Figure 10:
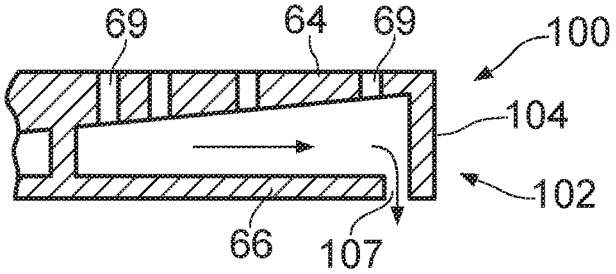
FIG. 10 is a cross-sectional view in a plane perpendicular to the axis of the combustion chamber of the portion of the combustion chamber shown in FIG. 9.
Figure 11:
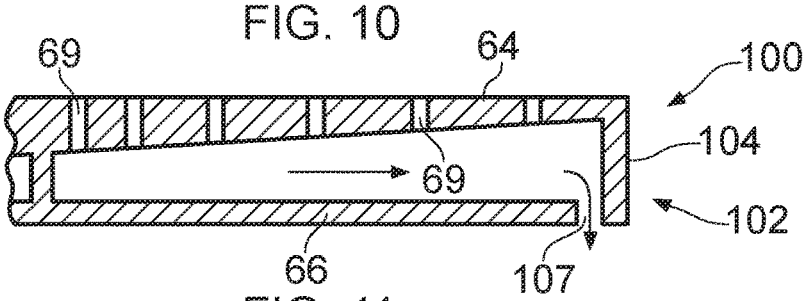
FIG. 11 is a cross-sectional view in a plane containing the axis of the combustion chamber of the portion of the combustion chamber shown in FIG. 9.
Figure 32:
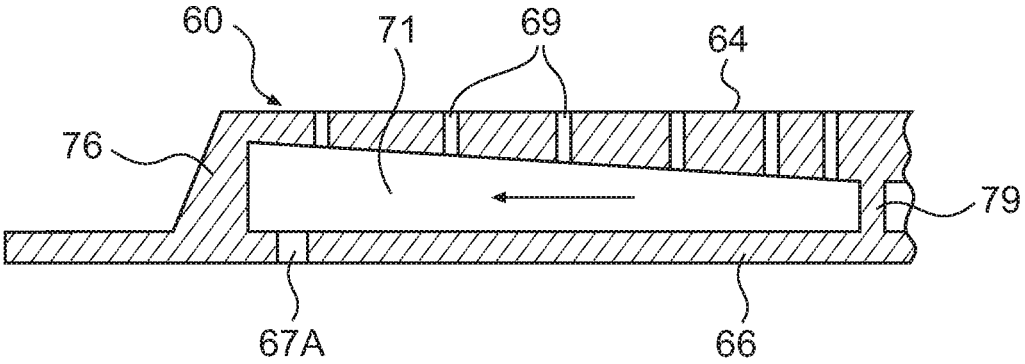
FIG. 32 is a cross-sectional view of a region at an upstream end of the combustion chamber segment.
Figure 33:
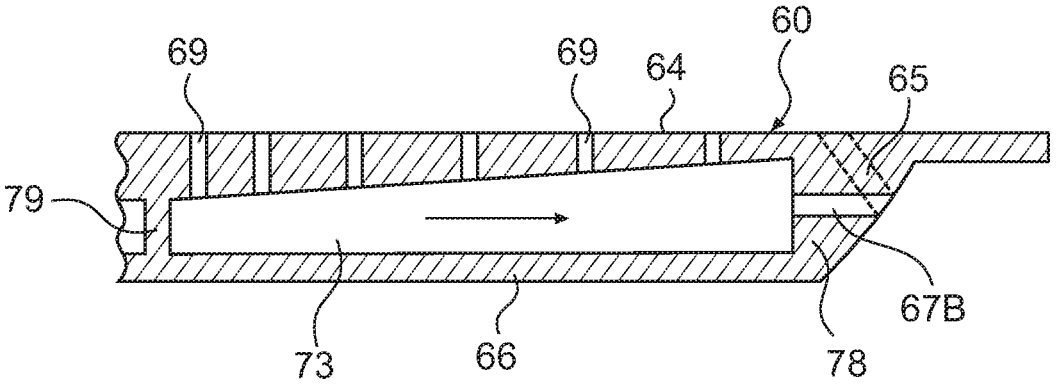
FIG. 33 is a cross-sectional view of a region at a downstream end of the combustion chamber segment.
Figure 35:
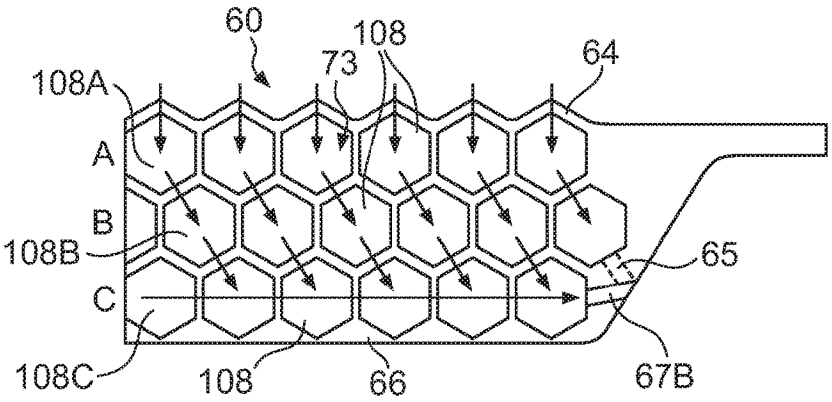
FIG. 35 is a view of the downstream end of the segments corresponding to the arrangement in FIG. 21.
Figure 34:
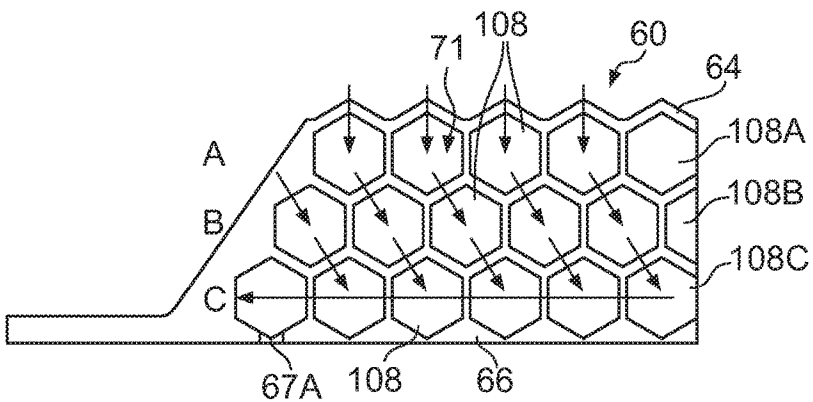
FIG. 34 is a view of the upstream end of the segments corresponding to the arrangement in FIG. 20.
Figure 37:
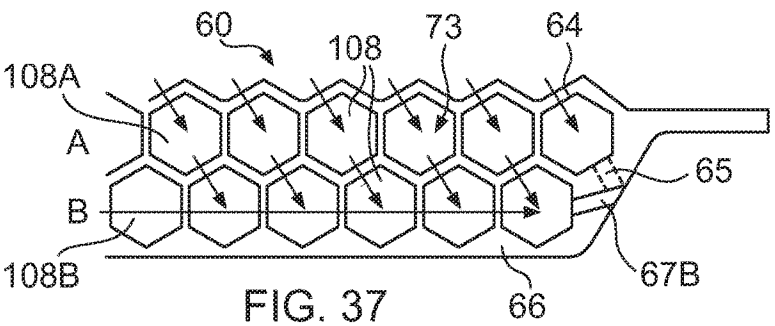
FIG. 37 is a view of the downstream end of the segments corresponding to the arrangement in FIG. 23.
Figure 36:
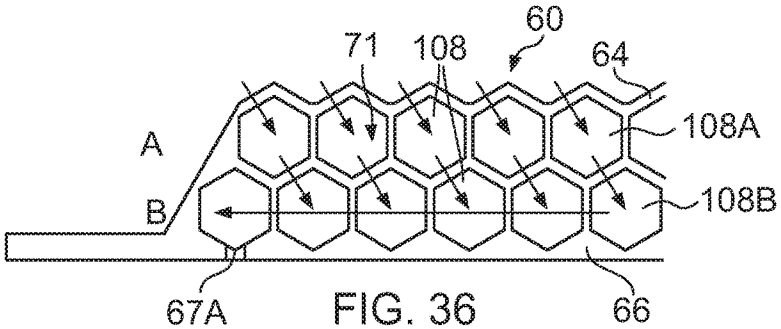
FIG. 36 is a view of the upstream end of the segments corresponding to the arrangement in FIG. 22.
Figure 39:
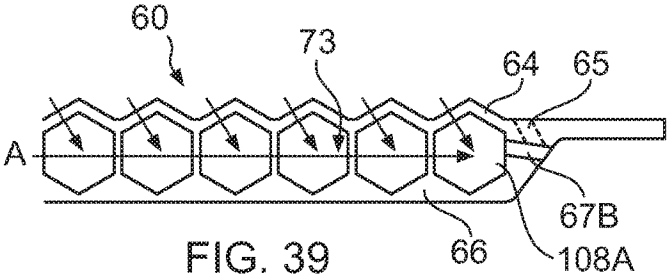
FIG. 39 is a view of the downstream end of the segments corresponding to the arrangement in FIG. 25.
Figure 38:
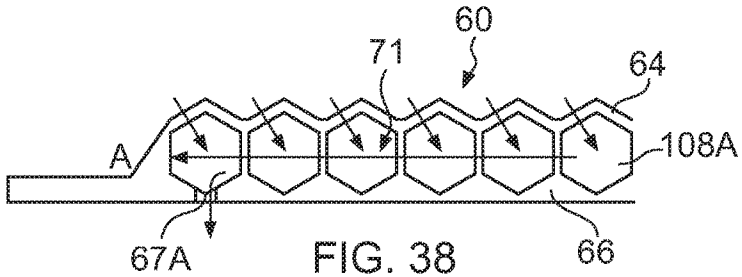
FIG. 38 is a view of the upstream end of the segments corresponding to the arrangement in FIG. 24.

In one arrangement for a rich burn combustion chamber as shown in FIGS. 9, 10 and 11 the interior of the box like structure of each combustion chamber segment 58, 60 of a rich burn combustion chamber is divided into the plurality of regions 71, 73 and 77 by a plurality of walls 79 which extend between the outer wall 64 and the inner wall 66 and each of the regions 71, 73 and 77 forms a separate chamber. The walls 79 may be straight, or arcuate, as appropriate to divide the interior of the box like structure of each combustion chamber 58, 60 into the regions 71, 73 and 77 while avoiding the dilution apertures 102, 104, dilution walls 104 and dilution chutes 106. The height of the chamber in the region 71 is greatest at the upstream end of region 71 and least adjacent the wall 79 at the downstream end of region 71 and the number of apertures 69 per unit length of the outer wall 64 decreases from the downstream end to the upstream end of region 71 (sec FIG. 32). The height of the chamber in the region 73 is greatest at the downstream end of region 73 and least adjacent the wall 79 at the upstream end of region 73 and the number of apertures 69 per unit length of the outer wall 64 decreases from the upstream end to the downstream end of the region 73 (see FIG. 33). Similarly, the height of the chamber in each of the regions 77 is greatest adjacent to the dilution aperture and least adjacent a wall 79 and the number of apertures 69 per unit length of the outer wall 64 decreases from adjacent the walls 79 to adjacent the dilution aperture 104, dilution wall 104 and dilution chute 106 of the region 77, as shown in FIGS. 10 and 11. The height decreases to achieve as uniform a velocity as possible within the chamber of each of the regions 71, 73 and 77 to control heal extraction such that the heat extraction from the inner wall 66 is substantially constant over the whole of the surface of the inner wall 66. The number of apertures 67 per unit area of the inner wall 66 may be constant. The apertures 69 in the outer wall 64 direct the coolant onto the inner wall 66 to provide impingement cooling of the inner wall 66. Some of the coolant within the regions 71, 73 and 77 flows through the apertures 67 in the inner wall 64 to provide effusion cooling, or film cooling, of the inner wall 64 and the remainder of the coolant in the regions 71, 73 and 77 flows in an upstream direction to the apertures 67A at the upstream end of the combustion chamber segments 58, 60, flows in a downstream direction to the apertures 67B at the downstream end of the combustion chamber segments 58, 60 and flows to the passages 107 adjacent the dilution chutes 107 of the combustion chamber segments 58, 60 as discussed above.

Figure 12:
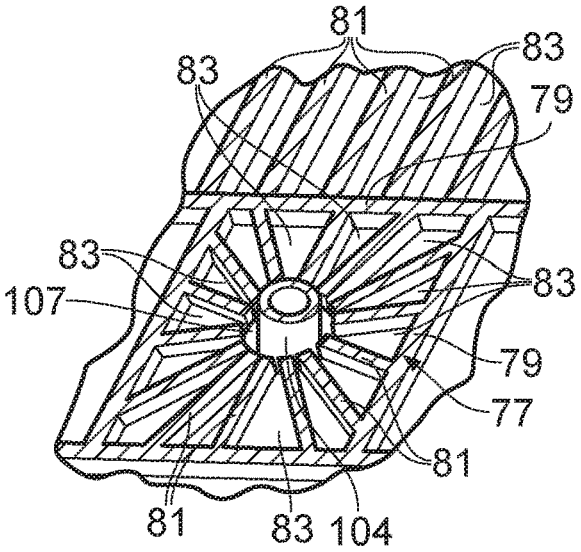
FIG. 12 is an alternative cut away perspective view of a portion of a combustion chamber segment shown in FIG. 5.

In another arrangement for a rich burn combustion chamber as shown in FIG. 12 the interior of the box like structure of each combustion chamber segment 58, 60 of a rich burn combustion chamber is again divided into a plurality of regions 71, 73 and 77 by a plurality of walls 79 which extend between the outer wall 64 and the inner wall 66. In addition each region 71, 73 and 77 has a plurality of walls 81 which extend between the outer wall 64 and the inner wall 66 and from a wall 79 to sub-divide the region into a plurality of ducts 83. The cross-sectional area of each duct 83 in the region 71 is greatest at the upstream end of region 71 and least adjacent the wall 79 at the downstream end of region 71 and the number of apertures 69 per unit length of the outer wall 64 decreases from the downstream end to the upstream end of region 71. The cross-sectional area of each duct 83 in the region 73 is greatest at the downstream end of region 73 and least adjacent the wall 79 at the upstream end of region 73 and the number of apertures 69 per unit length of the outer wall 64 decreases from the upstream end to the downstream end of the region 73. Similarly, the cross-sectional area of each duct 83 in each of the regions 77 is greatest adjacent to the dilution aperture 102, dilution wall 104 and dilution chute 106 and least adjacent the walls 79 and the number of apertures 69 per unit length of the outer wall 64 decreases from adjacent the walls 79 to adjacent the dilution aperture 102, dilution wall 104 and dilution chute 106 of the region 77. The cross-sectional area decreases along the length of each duct 83 to achieve as uniform a velocity as possible within each duct 83 to control heat extraction such that the heat extraction from the inner wall 66 is substantially constant over the whole of the surface of the inner wall 66. The cross-sectional area of each duct 83 is varied by varying the height and/or the width of the duct 83. The number of apertures 67 per unit area of the inner wall 66 may be constant. The apertures 69 in the outer wall 64 direct the coolant onto the inner wall 66 to provide impingement cooling of the inner wall 66. Some of the coolant within the regions 71, 73 and 77 flows through the apertures 67 in the inner wall 64 to provide effusion cooling, or film cooling, of the inner wall 64 and the remainder of the coolant in the regions 71, 73 and 77 flows in an upstream direction through the ducts 83 to the apertures 67A at the upstream end of the combustion chamber segments 58, 60, flows in a downstream direction through the ducts 83 to the apertures 67B at the downstream end of the combustion chamber segments 58, 60 and flows through the ducts 83 to the passages 107 adjacent the dilution chutes 107 of the combustion chamber segments 58, 60 as discussed above.

Figure 13:
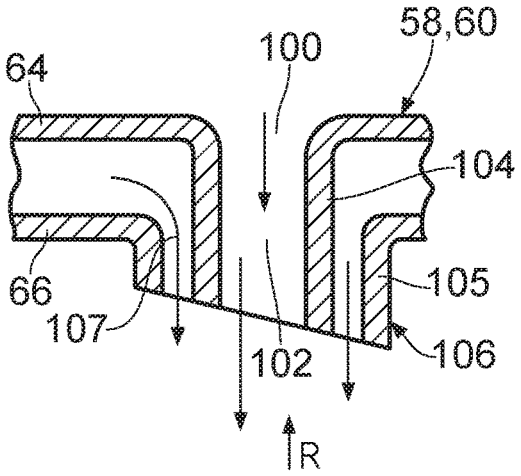
FIG. 13 is a cross-sectional view through an alternative dilution chute of a combustion chamber segment shown in FIG. 5.

FIG. 13 shows an alternative arrangement of dilution chute which may be used in a combustion chamber segment 58, 60 of any rich burn combustion chamber embodiment of the present disclosure. The dilution chute 106 is double skinned, e.g. is hollow, such that the coolant from the interior of a, or each, region 77 flows through at least one passage 107 within the dilution chute 106 and hence parallel to the flow of dilution air through the dilution chute 106. The dilution wall 104 forms the inner wall of the dilution chute 106 and an outer wall 105 extends from the inner wall 66 of the combustion chamber segment 58, 60. The at least one passage 107 may be an annular passage or may comprises a plurality of circumferentially spaced slots, arranged through the dilution chute 106. The flow of dilution air through each of the dilution ports as an ejector to draw, extract, the cooling air from within the respective third region 77 of the box like structure of each combustion chamber segment 58, 60 through the at least one passage 107 within the hollow dilution chute 106 and adjacent to the dilution port and into the combustion chamber. In particular the outer wall 105 is annular and the inner wall 104 is annular. The outer wall 105 may have a cylindrical inner surface and a cylindrical outer surface and the inner wall 104 may have a cylindrical outer surface and a cylindrical inner surface. The dilution ports, e.g. the dilution apertures, may have other suitable cross-sectional shapes e.g. oval, elliptical, triangular and the dilution walls and dilution chutes have corresponding shapes to define these dilution ports.

In a further arrangement for a rich burn combustion chamber, not shown, each combustion chamber segment 58, 60 has a cellular structure between the inner wall 66 and the outer wall 64, the cellular structure comprising a plurality of polyhedron shaped chambers arranged in a single layer. The cellular structure and the box like structure is an integral structure, e.g. a single piece structure or a monolithic structure. In the case of a combustion chamber segment the box like structure comprising the frame structure, the inner wall, the outer wall, and the cellular structure is an integral structure, e.g. a single piece structure or a monolithic structure. The polyhedron shaped chambers of the cellular structure in each of the region 71, 73 and 77 are arranged so that the coolant flows in an upstream direction through adjacent cells to the apertures 67A at the upstream end of the combustion chamber segment 58, flows in a downstream direction to the apertures 67B at the downstream end of the combustion chamber segment 58, 60 and to the passage, or passages, 107 adjacent the dilution chutes 106 of the combustion chamber segment 58, 60 respectively, as mentioned above. The polyhedron shaped chambers of the cellular structure in each region 71, 73 and 77 may not have apertures in the inner wall 66 so that all of the coolant flows to the apertures 67A at the upstream end of the combustion chamber segment 58, to the apertures 67B at the downstream end of the combustion chamber segment 58, 60 and to the passage, or passages, 107 adjacent the dilution chutes 106 of the combustion chamber segment 58, 60 respectively. Alternatively, the polyhedron shaped chambers of the cellular structure in each region 71, 73 and 77 may have apertures in the inner wall 66 so that some of the coolant forms a film of coolant on the inner surface of the inner wall 66 of the combustion chamber segment 58, 60.

In an additional arrangements for a rich burn combustion chamber each combustion chamber segment 58, 60 has a cellular structure between the inner wall 66 and the outer wall 64, the cellular structure comprising a plurality of polyhedron shaped chambers defined by a matrix of integral interconnected walls, the polyhedron shaped chambers are arranged in at least two layers between the inner wall 66 and the outer wall 64. At least some of the polyhedron shaped chambers in each layer are fluidly interconnected to at least some of the polyhedron shaped chambers in each adjacent layer by apertures extending through the integral interconnected walls of the polyhedron shaped chambers for the flow of coolant there-between. The apertures in the outer wall 64 allow a flow of coolant into the cellular structure and the apertures in the inner wall 66 allow a flow of coolant out of the cellular structure. The polyhedron shaped chambers may be parallelogram sided cuboid shaped chambers, square based pyramid shaped chambers, rhombic dodecahedron shaped chambers, elongated dodecahedron shaped chambers, truncated dodecahedron shaped chambers, truncated octahedron shaped chambers or two types of irregular polyhedron shaped chambers arranged in a Weaire-Phelan structure.

The cellular structure and the box like structure is an integral structure, e.g. a single piece structure or a monolithic structure. In the case of a combustion chamber segment the box like structure comprising the frame structure, the inner wall, the outer wall, and the cellular structure is an integral structure, e.g. a single piece structure or a monolithic structure. In the case of an annular wall the box like structure comprising the inner wall, the outer wall, the upstream end wall, the downstream end wall and the cellular structure is an integral structure, e.g. a single piece structure or a monolithic structure. The thickness of the wall of the polyhedron shaped chamber may be in the range of 0.2 to 2 mm. The distance between the walls of the polyhedron shaped chambers may be in the range of 1 to 4 mm.

Figure 16:
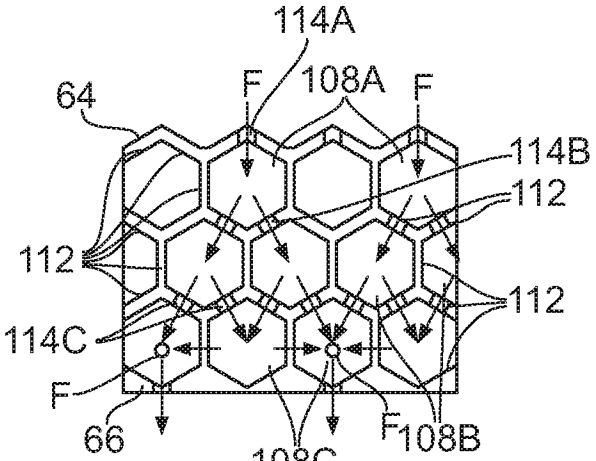
FIG. 16 is a schematic cross-sectional view in the direction of arrows S through the combustion chamber segment in FIG. 14.
Figure 15:
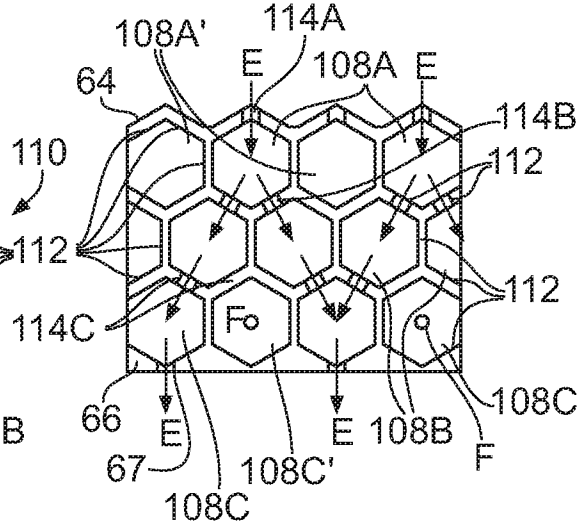
FIG. 15 is a schematic cross-sectional view in the direction of arrows T through the combustion chamber segment in FIG. 14.
Figure 14:
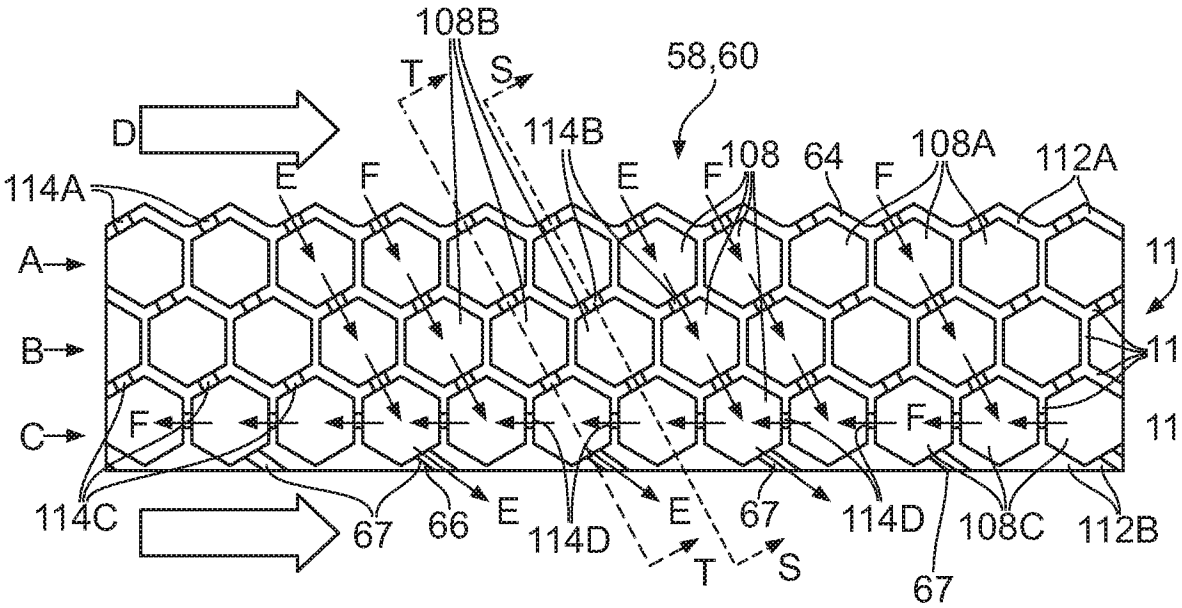
FIG. 14 is a further enlarged schematic cross-sectional view through a combustion chamber segment shown in FIG. 4, showing a cellular construction.

A combustion chamber segment 58, 60 of a rich burn combustion chamber is shown more clearly in FIGS. 14, 15 and 16. Each combustion chamber segment 58, 60 of the combustion chamber 15 is hollow and each combustion chamber segment 58, 60 comprises a plurality of polyhedron shaped chambers 108 defined by a matrix 110 of integral interconnected walls 112 and thus each combustion chamber segment 58, 60 comprises a single, monolithic or unitary, piece. The polyhedron shaped chambers 108 are arranged in three layers A, B and C between the outer wall 64 and the inner wall 66 of the combustion chamber segments 58, 60. The walls 112A of the polyhedron shaped chambers 108A in the first layer A define the outer wall 64 of the combustion chamber segment 58, 60, the walls 112B of the polyhedron shaped chambers 108C in the third layer C define the inner wall 66 of the combustion chamber segment 58, 60. Adjacent polyhedron shaped chambers 108 share a common wall. The polyhedron shaped chambers 108A, 108B and 108C in each layer A, B and C are interconnected to the polyhedron shaped chambers 108A, 108B and 108C in each adjacent layer A, B and C by apertures extending through the walls of the polyhedron shaped chambers 108 for the flow of coolant there-between. The walls of the polyhedron shaped chambers 108A in the first layer A have apertures 114A extending there-through to supply coolant D flowing over the outer wall 64 into the polyhedron shaped chambers 108A in the first layer A. The walls of the polyhedron shaped chambers 108A in the first layer A have apertures 114B extending there-through to supply coolant into the polyhedron shaped chambers 108B in the second layer B. The walls of the polyhedron shaped chambers 108B in the second layer B have apertures 114C extending there-through to supply coolant into the polyhedron shaped chambers 108C in the third layer C. It is to be noted that a first flow of coolant E flows into polyhedron shaped chambers 108A in alternate rows in the first layer A, into the polyhedron shaped chambers 108B in the second layer B, into the polyhedron shaped chambers 108C in the third layer C and then through apertures 67 to form a film of coolant on the inner surface of the inner wall 66, as shown in FIG. 15. A second flow of coolant F flows into polyhedron shaped chambers 108A in alternate rows in the first layer A, into the polyhedron shaped chambers 108B in the second layer B, into the polyhedron shaped chambers 108C in the third layer C, as shown in FIG. 16.

The polyhedron shaped chambers of the cellular structure in each of the regions 71, 73 and 77 are arranged so that the second flow of coolant F flows through adjacent polyhedron shaped chambers to the apertures 67A at the upstream end of the combustion chamber segment 58, to the apertures 67B at the downstream end of the combustion chamber segment 58, 60 and to the passage, or passages, 107 adjacent the dilution chutes 106 of the combustion chamber segment 58, 60 respectively, as mentioned above.

For example in region 71 the walls of the polyhedron shaped chambers 108C in the third layer C have apertures 114D extending generally longitudinally, e.g. axially, there-through to supply coolant F from the polyhedron shaped chambers 108C in the third layer C into adjacent polyhedron shaped chambers 108C positioned upstream thereof and to receive coolant F from the adjacent polyhedron shaped chambers 108C in the third layer C positioned downstream thereof.

The apertures 114A are preferably arranged in the walls of the polyhedron shaped chambers 108A facing in an upstream direction, as shown in FIG. 14 to enable a controlled flow of coolant E and F into the first layer A of chambers 108A. However, the apertures 104A may be arranged in the walls of the polyhedron shaped chambers 108A facing in a downstream direction. The apertures 114B are preferably arranged in the walls of the polyhedron shaped chambers 108A facing in an upstream direction, as shown in FIG. 14, to enable a controlled flow of coolant E and F from the chambers 108A of first layer A into the chambers 108B in the second layer B. However, the apertures 114B may be arranged in the walls of the polyhedron shaped chambers 108A facing in a downstream direction. The apertures 114C are preferably arranged in the walls of the polyhedron shaped chambers 108B facing in an upstream direction as shown in FIG. 14 to enable a controlled flow of coolant E and F from the chambers 108B in the second layer B into the chambers 108C in the third layer C. However, the apertures 114C may be arranged in the walls of the polyhedron shaped chambers 108B facing in a downstream direction in the walls of the polyhedron shaped chambers 108B. The apertures 114D are arranged in the walls of the polyhedron shaped chambers 108C facing in an upstream direction, as shown in FIG. 14 to enable a controlled flow of coolant F through the third layer C of chambers 108C in an upstream longitudinal, axial, direction over the outer surface of the inner wall 66 of the combustion chamber segment 58, 60 to cool the inner wall 66 of the combustion chamber segment 58, 60.

The polyhedron shaped chambers 108C and the apertures 114D define, or provide, a number of ducts extending longitudinally, e.g. axially, over the outer surface of the inner wall 66. The inner wall 66 of the combustion chamber segment 58, 60 has a plurality of apertures 67A extending there-through at the upstream of the combustion chamber segment 58, 60 but downstream of the first, upstream, end wall 76 of the combustion chamber segment 58, 60. The apertures 67A extend from one or more rows of the polyhedron shaped chambers 108C at the upstream end of the third layer C. In region 71 the flow of coolant F is arranged to flow in an upstream direction to the apertures 67A at the upstream end of the combustion chamber segments 58, 60, in region 73 the flow of coolant F would be arranged to flow in a downstream direction to the apertures 67B at the downstream end of the combustion chamber segments 58, 60 and in regions 77, the coolant F would be arranged to flow to the passage 107. The polyhedron shaped chambers 108 may be octahedral.

The outer wall 64 of the combustion chamber segment 58, 60 is multi-faceted, as shown in FIG. 14 and the facets are defined by the walls of the polyhedron shaped chambers 108A in the first layer A. Some of the facets defined by the walls of the polyhedron shaped chambers 108A in the first layer A face in an upstream direction and some of the facets defined by the walls of the polyhedron shaped chamber 108A in the first layer A face in a downstream direction. The facets defined by the walls of the polyhedron shaped chambers 108A facing in an upstream direction have the apertures 114A extending there-through to supply coolant D into the polyhedron shaped chambers 108A in the first layer A. The apertures 114A in the facets, or walls, of the polyhedron shaped chambers 108A facing in an upstream direction may have the same cross-sectional area as the facets of the polyhedron shaped chambers 108A such that the facets, or walls, of the polyhedron shaped chambers 108A facing in a downstream direction form scoops to supply coolant D into the polyhedron shaped chambers 108A in the first layer A. The scoops provide a total pressure feed of coolant into the outer wall 64 of the combustion chamber segment 58, 60.

The inner wall 66 of the combustion chamber segment 58, 60 is cylindrical, as shown in FIG. 14 and the facets, or walls, of the polyhedron shaped chambers 108C defining the inner wall 66 of the combustion chamber segment 58, 60.

The apertures 67 in the inner wall 66 of each combustion chamber segment 58, 60 may be arranged perpendicularly to the surface of the inner wall 66 or at non-perpendicular angle to the surface of the inner wall 66 and the apertures 67 in the inner wall 66 provide effusion cooling of the inner wall 66. The apertures 67 in the inner wall 66 of each combustion chamber segment 58, 60 arranged at a non-perpendicular angle to the surface of the inner wall 66 may be angled in a longitudinal, axial, direction.

The flow of coolant E and F through the combustion chamber segment 58, 60 is shown more clearly in FIGS. 15 and 16. In particular the coolant E flows through an aperture 114A in the outer wall 112A of each polyhedron shaped chamber 108A and into a respective polyhedron shaped chamber 108A. It is to be noted that the coolant E is then supplied from circumferentially alternate ones of the polyhedron shaped chamber 108A of the first layer A through apertures 114B into two circumferentially adjacent polyhedron shaped chambers 108B in the second layer B. Additionally it is to be noted that the polyhedron shaped chambers 108A' in the first layer A which are positioned circumferentially between the polyhedron shaped chambers 108A which supply coolant to the polyhedron shaped chambers 108B in the second layer B do not have apertures connecting these polyhedron shaped chambers 108A' to polyhedron shaped chambers 108B in the second layer B. The polyhedron shaped chambers 108A' thus reduce the weight of the combustion chamber segment 58, 60 but do not allow a flow of coolant. The apertures 114A in the polyhedron shaped chambers 108A' allow removal of the metal powder used during manufacture, see below. The coolant E is than supplied from each polyhedron shaped chamber 108B in the second layer B into one of the two circumferentially adjacent polyhedron shaped chambers 108C in the third layer C through the apertures 114C. The coolant E flowing through the apertures 114C from two circumferentially adjacent polyhedron shaped chambers 108B in the second layer B into a polyhedron shaped chamber 108C in the third layer C comprises jets of coolant which collide, or impinge on each other, to enhance turbulence and heat transfer within the polyhedron shaped chambers 108C in the third layer C. The coolant E then flows though the apertures 67 to provide effusion cooling by providing a film of coolant on the inner surface of the inner wall 66. It is to be noted that the polyhedron shaped chambers 108C' in the third layer C which are positioned circumferentially between the polyhedron shaped chambers 108C which supply coolant onto the inner surface of the inner wall 66 do not have apertures connecting these polyhedron shaped chambers 108C' to the circumferentially adjacent polyhedron shaped chambers 108B in the second layer B.

The coolant F flows through an aperture 114A in the outer wall 112A of each polyhedron shaped chamber 108A and into a respective polyhedron shaped chamber 108A. It is to be noted that the coolant F is then supplied from circumferentially alternate ones of the polyhedron shaped chamber 108A of the first layer A through apertures 114B into two circumferentially adjacent polyhedron shaped chambers 108B in the second layer B. Additionally it is to be noted that the polyhedron shaped chambers 108A' in the first layer A which are positioned circumferentially between the polyhedron shaped chambers 108A which supply coolant to the polyhedron shaped chambers 108B in the second layer B do not have apertures connecting these polyhedron shaped chambers 108A' to polyhedron shaped chambers 108B in the second layer B. The polyhedron shaped chambers 108A' thus reduce the weight of the combustion chamber segment 58, 60 but do not allow a flow of coolant. The apertures 114A in the polyhedron shaped chambers 108A' allow removal of the metal powder used during manufacture, see below. The coolant F is than supplied from each polyhedron shaped chamber 108B in the second layer B into two circumferentially adjacent polyhedron shaped chambers 108C in the third layer C through the apertures 114C. The coolant F flowing through the apertures 114C from two circumferentially adjacent polyhedron shaped chambers 108B in the second layer B into a polyhedron shaped chamber 108C in the third layer C comprises jets of coolant which collide, or impinge on each other, to enhance turbulence and heat transfer within the polyhedron shaped chambers 108C in the third layer C. The coolant F then flows though the apertures 114D into the polyhedron shaped chambers 108C' in the third layer C in an adjacent row which are positioned circumferentially between the polyhedron shaped chambers 108C which supply coolant onto the inner surface of the inner wall 66. The coolant F then flows in an upstream direction through adjacent polyhedron shaped chambers 108C in the third layer C through the apertures 114D over the outer surface of the inner wall 66 of the combustion chamber segment 58, 60 to cool the inner wall 66 of the combustion chamber segment 58, 60. The arrangement of FIGS. 14, 15 and 16 provides dendritic cooling of the combustion chamber segments 58, 60.

The polyhedron shaped chambers 108C in the third layer C at the upstream end of the combustion chamber segment 58, 60 are provided with apertures 67A to provide a film of coolant which flows in a downstream direction over the inner surface of the inner wall 66 of the combustion chamber segment 58, 60 to further cool the inner wall 66 of the combustion chamber segment 58, 60. The polyhedron shaped chambers 108C in the third layer C at the downstream end of the combustion chamber segment 58, 60 are provided with apertures 67B to provide a film of coolant which flows in a downstream direction over the radially outer and radially inner surfaces of the platforms of the nozzle guide vanes 52. The polyhedron shaped chambers 108C in the third layer C adjacent each dilution chute 106 supply coolant through the passages 107 to provide further mixing air into the combustion chamber.

Thus, in FIGS. 14 to 16 there is a flow of coolant F over the outer surface of the inner wall 66 in some of the polyhedron shaped chambers in the third layer C and some of the polyhedron shaped chambers in the third layer C provide a flow of coolant E over the inner surface of the inner wall 66.

Figure 18:
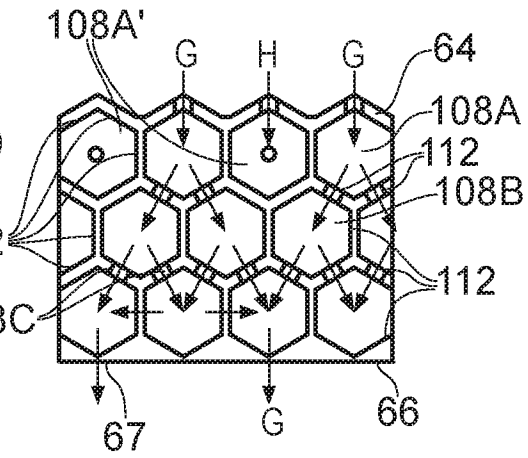
FIG. 18 is a schematic cross-sectional view in the direction of arrows U through the combustion chamber segment in FIG. 17.
Figure 17:
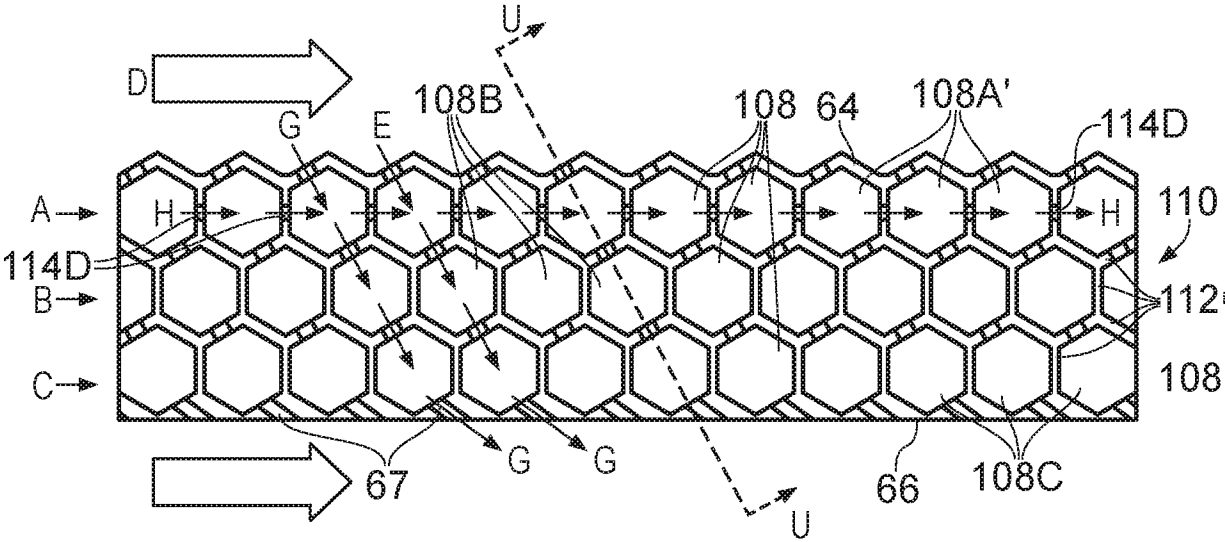
FIG. 17 is a further enlarged schematic cross-sectional view through a combustion chamber segment shown in FIG. 4, showing an alternative cellular construction.

Another combustion chamber segment 58, 60 of a rich burn combustion chamber is shown more clearly in FIGS. 17 and 18. This arrangement is similar to that in FIGS. 14 to 16, but as an example in region 73 the walls of the polyhedron shaped chambers 108A' in the first layer A have apertures 114D extending generally longitudinally, e.g. axially, therethrough to supply coolant H from the polyhedron shaped chambers 108A' in the first layer A into adjacent polyhedron shaped chambers 108A' positioned downstream thereof and to receive coolant H from the adjacent polyhedron shaped chambers 108A' in the first layer A positioned upstream thereof. All of the coolant flow G is supplied to the third layer C and through apertures 67 to provide a film of coolant on the inner surface of the inner wall 66. In region 73 the flow of coolant H would be arranged to flow in a downstream direction to the apertures 67B. In region 71 the flow of coolant H would be arranged to flow in an upstream direction to the apertures 67A and in regions 77, the coolant H would be arranged to flow to the passage 107. The polyhedron shaped chambers 108 may be dodecahedral.

Thus, in FIGS. 17 and 18 there is a flow of coolant H over the outer surface of the polyhedron shaped chambers in the second layer B in some of the polyhedron shaped chambers 108A' in the first layer A and all of the polyhedron shaped chambers 108C in the third layer C provide a flow of coolant G over the inner surface of the inner wall 66.

Figure 19:
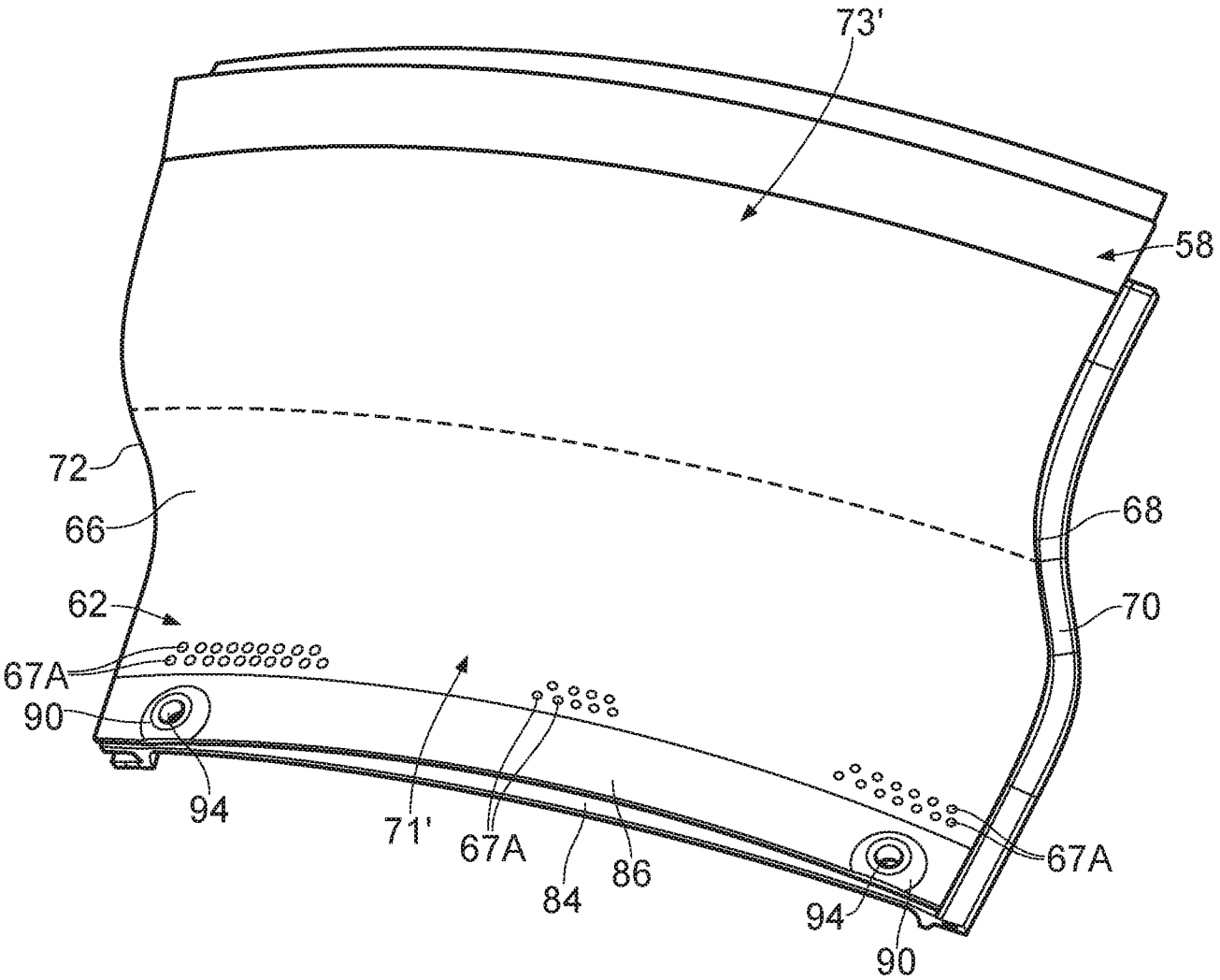
FIG. 19 is a further enlarged perspective view of a hot side of an alternative combustion chamber segment shown in FIG. 3.
Figure 24:
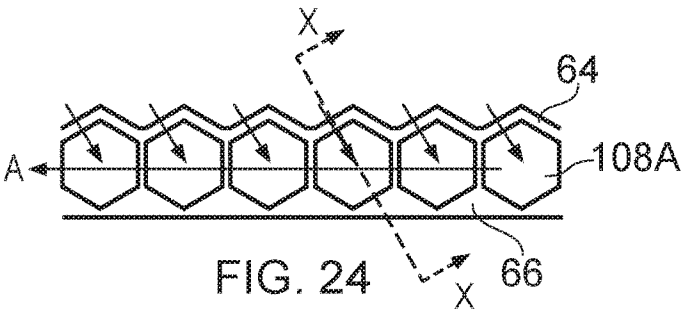
FIG. 24 is a further enlarged schematic cross-sectional view through a combustion chamber segment shown in FIG. 19, showing an alternative cellular construction.
Figure 22:
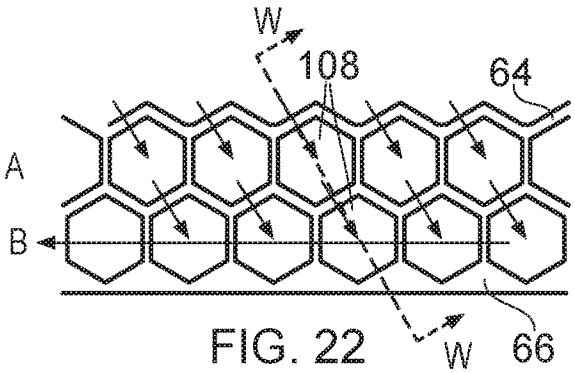
FIG. 22 is a further enlarged schematic cross-sectional view through a combustion chamber segment shown in FIG. 19, showing an alternative cellular construction.
Figure 20:
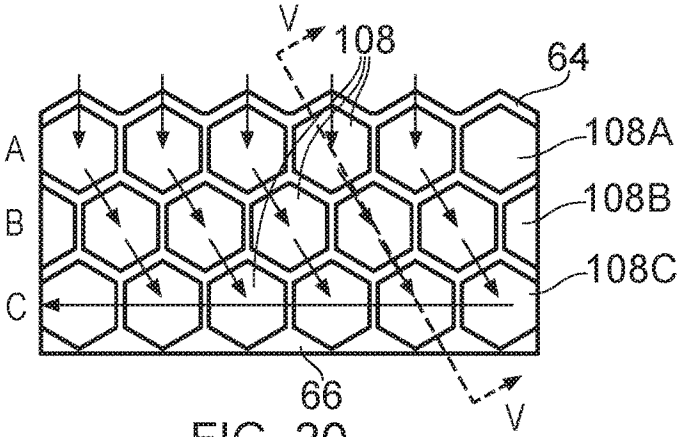
FIG. 20 is a further enlarged schematic cross-sectional view through a combustion chamber segment shown in FIG. 19, showing a cellular construction.
Figure 25:
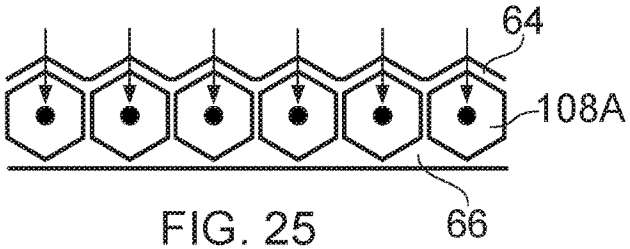
FIG. 25 is a schematic cross-sectional view in the direction of arrows X through the combustion chamber segment in FIG. 24.
Figure 23:
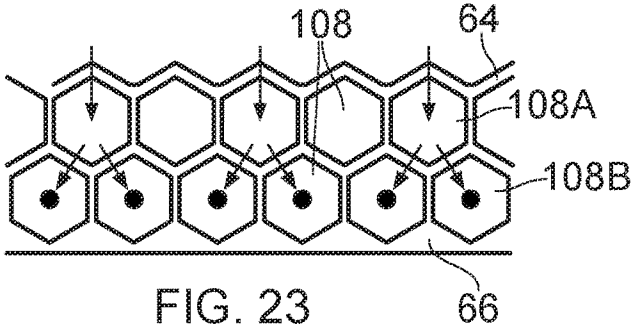
FIG. 23 is a schematic cross-sectional view in the direction of arrows W through the combustion chamber segment in FIG. 22.
Figure 21:
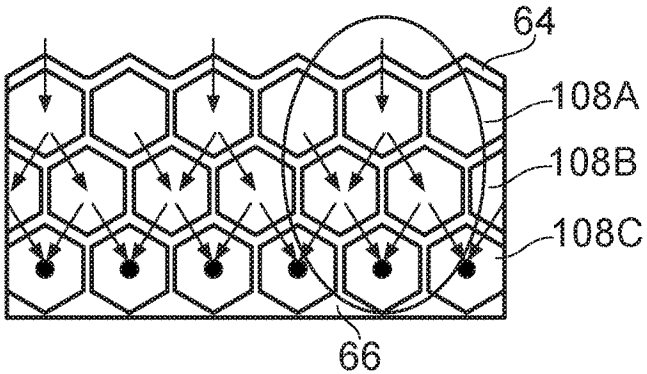
FIG. 21 is a schematic cross-sectional view in the direction of arrows V through the combustion chamber segment in FIG. 20.

If the combustion chamber 16 is a lean burn combustion chamber the combustion chamber segments 58, 60 are not provided with dilution apertures, dilution walls and dilution chutes, as shown in FIG. 19. The interior of the box like structure of each combustion chamber segment 58, 60 of a lean burn combustion chamber is divided into a plurality of regions 71' and 73'. A first region 71' of the interior of each combustion chamber segment 58, 60 is arranged at an upstream end of the combustion chamber segment 58, 60. A second region 73' of the interior of each combustion chamber segment 58, 60 is arranged at a downstream end of the combustion chamber segment 58, 60. The upstream end of the box like structure of each combustion chamber segment 58, 60 has a plurality of apertures 67A to supply coolant from the first region 71' of the interior of the box like structure and onto an inner surface of the inner wall 66 to form a film of coolant which flows in a downstream direction over the inner surface of the inner wall 66 of the combustion chamber segment 58, 60 to cool the inner wall 66 of the combustion chamber segment 58, 60. The downstream end of the box like structure of each combustion chamber segment 58 has a plurality of apertures 67B to supply coolant from the second region 73' of the interior of the box like structure and onto a surface of the inner platforms of the turbine nozzle guide vanes 52 to form a film of coolant which flows in a downstream direction over the surfaces of the inner platforms to cool the inner platforms of the turbine nozzle guide vanes 52. Similarly, the downstream end of the box like structure of each combustion chamber segment 60 has a plurality of apertures 67B to supply coolant from the second region 73' of the interior of the box like structure and onto a surface of the outer platforms of the turbine nozzle guide vanes 52 to form a film of coolant which flows in a downstream direction over the surfaces of the outer platforms to cool the outer platforms of the turbine nozzle guide vanes 52. The upstream end wall structure 44 is again provided with a plurality of apertures 47A extending through the upstream end wall 41 to provide a starter film of coolant over the inner surfaces of the combustion chamber segments 58 and to draw coolant out of the regions 71' through the apertures 67A of the combustion chamber segments 58 and a plurality of apertures 47B extending through the upstream end wall 41 to provide a starter film of coolant over the inner surfaces of the combustion chamber segments 60 and to draw coolant out of the regions 71' through the apertures 67A of the combustion chamber segments 60.

The first and second regions 71' and 73' may be arranged in a similar manner to the first and second regions 71 and 73 described with reference to FIGS. 9 to 12. It is to be noted that there are only the apertures 67A extending through the inner wall 66 at the upstream end of the first region 71' to provide a film of coolant on the inner surface of the inner wall 66 of the combustion chamber segments 58 and/or 60 and the apertures 67B extending through the inner wall 66 at the downstream end of the second region 73' of the combustion chamber segments 58 and/or 60 to provide a film of coolant on the surfaces of the inner platforms or the outer platforms of the nozzle guide vanes 52. There are no other apertures 67 in the first region 71' and no other apertures 67 in the second region 73' extending through the inner wall 66 of the combustion chamber segments 58 and/or 60 to provide a film of coolant on the inner surface of the inner wall 66 of each combustion chamber segment 58, 60, e.g. the inner wall 66 is imperforate between the apertures 67A at the upstream end of the first region 71' and the apertures 67B at the downstream end of the second region 73' of the combustion chamber segments 58 and/or 60.

In one arrangement for a lean burn combustion chamber the interior of the box like structure of each combustion chamber segment 58, 60 of a lean burn combustion chamber is divided into the plurality of regions 71' and 73' by a wall 79 which extends between the outer wall 64 and the inner wall 66 and both of the regions 71' and 73' forms a separate chamber. The wall 79 may be straight, or arcuate, as appropriate to divide the interior of the box like structure of each combustion chamber 58, 60 into the regions 71' and 73'. The height of the chamber in the region 71' is greatest at the upstream end of region 71' and least adjacent the wall 79 at the downstream end of region 71' and the number of apertures 69 per unit length of the outer wall 64 decreases from the downstream end to the upstream end of region 71'. The height of the chamber in the region 73' is greatest at the downstream end of region 73' and least adjacent the wall 79 at the upstream end of region 73' and the number of apertures 69 per unit length of the outer wall 64 decreases from the upstream end to the downstream end of the region 73'. The height decreases to achieve as uniform a velocity as possible within the chamber of each of the regions 71' and 73' to control heat extraction such that the heat extraction from the inner wall 66 is substantially constant over the whole of the surface of the inner wall 66. The apertures 69 in the outer wall 64 direct the coolant onto the inner wall 66 to provide impingement cooling of the inner wall 66. The coolant in the regions 71' and 73' flows in an upstream direction to the apertures 67A at the upstream end of the combustion chamber segments 58, 60 and flows in a downstream direction to the apertures 67B at the downstream end of the combustion chamber segments 58, 60 as discussed above.

In another arrangement for a lean burn combustion chamber the interior of the box like structure of each combustion chamber segment 58, 60 of a lean burn combustion chamber is again divided into a plurality of regions 71' and 73' by a wall 79 which extends between the outer wall 64 and the inner wall 66. In addition each region 71' and 73' has a plurality of walls 81 which extend between the outer wall 64 and the inner wall 66 and from a wall 79 to sub-divide the region into a plurality of ducts 83. The cross-sectional area of each duct 83 in the region 71' is greatest at the upstream end of region 71' and least adjacent the wall 79 at the downstream end of the region 71' and the number of apertures 69 per unit length of the outer wall 64 decreases from the downstream end to the upstream end of region 71'. The cross-sectional area of each duct 83 in the region 73' is greatest at the downstream end of region 73' and least adjacent the wall 79 at the upstream end of region 73' and the number of apertures 69 per unit length of the outer wall 64 decreases from the upstream end to the downstream end of the region 73'. The cross-sectional area decreases along the length of each duct 83 to achieve as uniform a velocity as possible within each duct 83 to control heat extraction such that the heat extraction from the inner wall 66 is substantially constant over the whole of the surface of the inner wall 66. The cross-sectional area of each duct 83 is varied by varying the height and/or the width of the duct 83. The apertures 69 in the outer wall 64 direct the coolant onto the inner wall 66 to provide impingement cooling of the inner wall 66. The coolant in the regions 71' and 73' flows in an upstream direction through the ducts 83 to the apertures 67A at the upstream end of the combustion chamber segments 58, 60, and flows in a downstream direction through the ducts 83 to the apertures 67B at the downstream end of the combustion chamber segments 58, 60 as discussed above.

Another combustion chamber segment 58, 60 of a lean burn combustion chamber is shown more clearly in FIGS. 20, 21, 34 and 35. This arrangement is similar to that in FIGS. 14 to 16, but there are no apertures 67 extending through the inner wall 66 from the polyhedron shaped chamber 108C in the third layer C to provide a film of coolant on the inner surface of the inner wall 66 of the combustion chamber segments 58, 60. In this example the polyhedron shaped chamber 108C in the third layer C are interconnected to axially adjacent polyhedron shaped chamber 108C in the third layer C so that all the coolant supplied to the polyhedron shaped chamber 108C in the third layer C in the region 71' is supplied in an upstream direction to the apertures 67A and all the coolant supplied to the polyhedron shaped chamber 108C in the third layer C in the region 73' is supplied in a downstream direction to the apertures 67B.

Another combustion chamber segment 58, 60 of a lean burn combustion chamber is shown more clearly in FIGS. 22, 23, 36 and 37 This arrangement is similar to that in FIGS. 20, 21, 34 and 35 but there are only two layers of polyhedron shaped chambers 108 and again there are no apertures 67 extending through the inner wall 66 from the polyhedron shaped chamber 108B in the second layer B to provide a film of coolant on the inner surface of the inner wall 66 of the combustion chamber segments 58, 60. In this example the polyhedron shaped chamber 108B in the second layer B are interconnected to axially adjacent polyhedron shaped chamber 108B in the second layer B so that all the coolant supplied to the polyhedron shaped chamber 108B in the second layer B in the region 71' is supplied in an upstream direction to the apertures 67A and all the coolant supplied to the polyhedron shaped chamber 108B in the second layer B in the region 73' is supplied in a downstream direction to the apertures 67B.

Another combustion chamber segment 58, 60 of a lean burn combustion chamber is shown more clearly in FIGS. 24, 25, 38 and 39. This arrangement is similar to that in FIGS. 20, 21, 34 and 35, but there is only a single layer of polyhedron shaped chambers 108 and again there are no apertures 67 extending through the inner wall 66 from the polyhedron shaped chamber 108A in the layer A to provide a film of coolant on the inner surface of the inner wall 66 of the combustion chamber segments 58, 60. In this example the polyhedron shaped chamber 108A in the layer A are interconnected to axially adjacent polyhedron shaped chamber 108A in the layer A so that all the coolant supplied to the polyhedron shaped chamber 108A in the layer A in the region 71' is supplied in an upstream direction to the apertures 67A and all the coolant supplied to the polyhedron shaped chamber 108A in the layer A in the region 73' is supplied in a downstream direction to the apertures 67B.

The walls, or facets, of the polyhedron shaped chambers 108A form the outer wall 64 of the combustion chamber segment 58, 60 and it is to be noted that these walls, or facets, form an undulating surface in both a circumferential and an axial direction and this undulating surface increases the heat transfer from the outer wall 64 of the combustion chamber segments 58, 60 into the coolant flowing over the outer wall 64 of the combustion chamber segment 58, 60.

The thickness of the walls of the polyhedron shaped chambers 108A, 108B and 108C is preferably in the range of 0.2 to 2 mm, e.g. 0.5 to 1 mm, and the distance between the walls of the polyhedron shaped chambers 108A, 108B and 108C is preferably in the range of 1 to 4 mm. The thickness of the walls of the polyhedron shaped chambers 108A, 108B and 108C may be different, for example the walls in the third layer C may be thicker than the walls in the second layer B and the walls in the second layer B may be thicker than the walls in the first layer A, e.g. the walls of the polyhedron shaped chambers decrease in thickness from the inner wall 66 to the outer wall 64.

The polyhedron shaped chambers may be rhombic dodecahedron shaped chambers and each facet/wall of the rhombic dodecahedron has a rhombic shape and all of the polyhedron shaped chambers may have the same shape, the same volume, same dimensions, etc. Other polyhedron shaped chambers may be used for example parallelogram sided cuboid shaped chambers, square based pyramid shaped chambers, elongated dodecahedron shaped chambers, truncated dodecahedron shaped chambers, truncated octahedron shaped chambers or two types of polyhedron shaped chambers, e.g. two types of irregular polyhedron shaped chambers arranged in a Weaire-Phelan structure. In addition spherical shaped chambers or spheroidal shaped chambers may be used.

Figure 26:
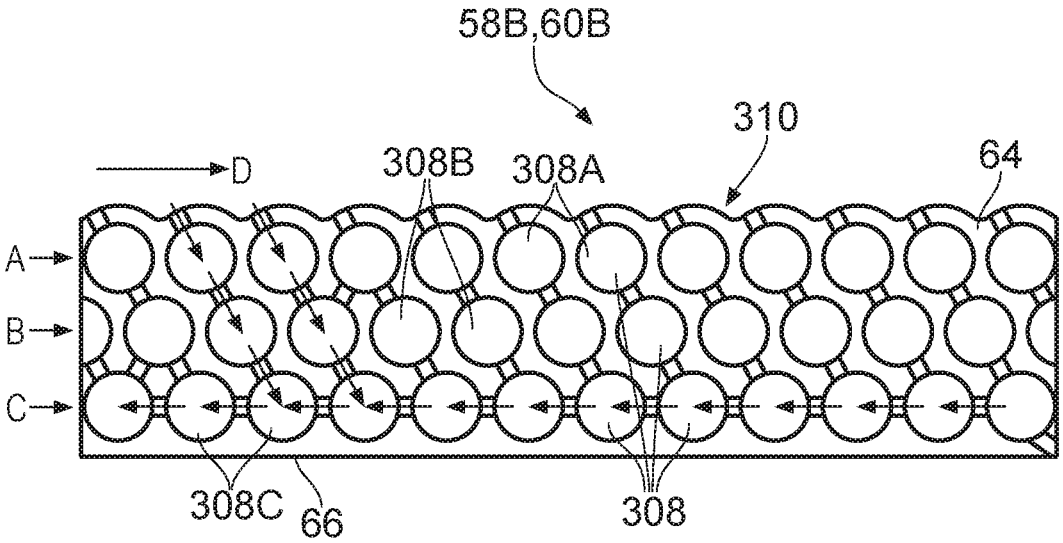
FIG. 26 is a further enlarged schematic cross-sectional view through a combustion chamber segment shown in FIG. 19, showing an alternative cellular construction.

An alternative combustion chamber segment 58B, 60B is shown more clearly in FIG. 26. Each combustion chamber segment 58B, 60B of the combustion chamber 15 is hollow and each combustion chamber segment 58B, 60B comprises a plurality of spherical shaped chambers 308 defined by a matrix 310 of integral interconnected walls 312 and thus each combustion chamber segment 58B, 60B comprises a single, monolithic or unitary, piece. The spherical shaped chambers 308 are arranged in three layers A, B and C between the outer wall 64 and the inner wall 66 of the combustion chamber segments 58B, 60B. However, an arrangement with one layer, two layers or more than three layers may be used. This may be used for a lean burn combustion chamber or a rich burn combustion chamber as described above.

Figure 27:
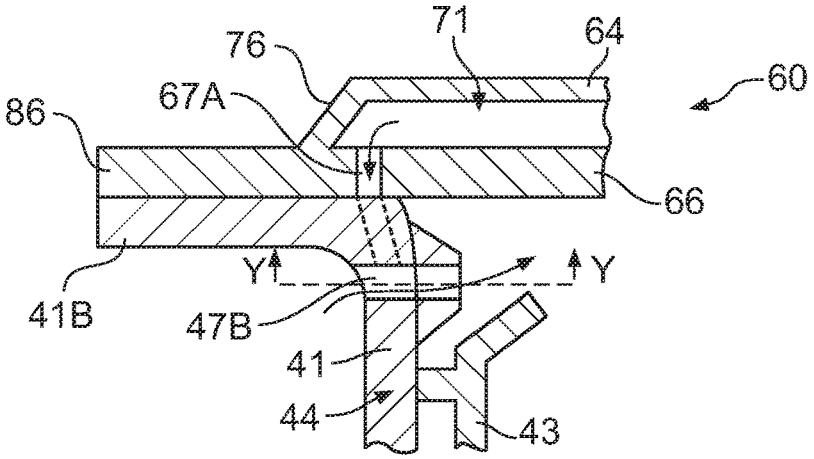
FIG. 27 is an enlarged cross-sectional view of the upstream end of a combustion chamber segment and the upstream end wall structure of the combustion chamber.
Figure 28:
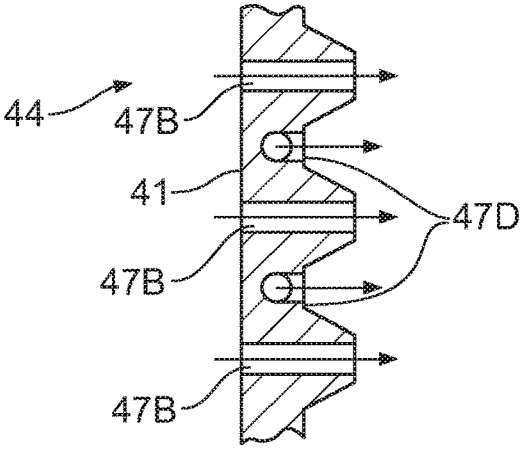
FIG. 28 is a cross-sectional view on the direction of arrows Y in FIG. 27.

An arrangement of the apertures 47B and the apertures 67A at the upstream end of the combustion chamber segments 60 is shown in FIGS. 27 and 28. As mentioned previously a plurality of apertures 47B extend through the upstream end wall 41 to provide a starter film of coolant over the inner surfaces of the combustion chamber segments 60. The apertures 47B are spaced apart circumferentially and a plurality of L-shaped passages 47D are also arranged in the upstream end wall 41. Each L-shaped passage 47D is provided circumferentially between two circumferentially adjacent apertures 47B. Each L-shaped passage has a first portion extending parallel with the apertures 47B and a second portion extending radially outwardly. Each aperture 67A at the upstream end of a combustion chamber segment 60 is aligned axially and circumferentially with the second portion of a respective one of the L-shaped passages 47D to supply coolant into the L shaped passage 47D. Thus, in operation the flow of coolant through the apertures 47B creates low static pressure adjacent to the L shaped passages 47D to draw coolant out of the regions 71 of the combustion chamber segments 60 through the apertures 67A. In a similar manner L shaped passages are provided between the circumferentially spaced apertures 47A in the upstream end wall 41. Each aperture 67A at the upstream end of a combustion chamber segment 58 is aligned axially and circumferentially with the second portion of a respective one of the L-shaped passages 47D to supply coolant into the L shaped passage 47D. The apertures 47B and the first portion of each L shaped passage 47D are arranged at the same radius and the apertures 47A and the first portion of each L shaped passage 47D are arranged at the same radius. Thus, in operation the flow of coolant through the apertures 47A creates low static pressure adjacent to the L shaped passages 47D to draw coolant out of the regions 71 of the combustion chamber segments 58 through the apertures 67A. The flow of coolant through the L shaped passages 47D, from the apertures 67A at the upstream ends of the combustion chamber segments 58, 60 enhances the starter film created by the apertures 47A and 47B on the inner surfaces of the combustion chamber segments 58, 60. The apertures 47B and the first portion of each L shaped passage 47D may alternatively be arranged at different radii but in proximity to each other and the apertures 47A and the first portion of each L shaped passage 47D may alternatively be arranged at different radii but in proximity to each other so that in operation the flow of coolant through the apertures 47A and 47B creates low static pressure adjacent to the apertures 67A to draw coolant out of the regions 71 of the combustion chamber segments 60 through the apertures 67A. In another arrangement, not shown, it may be possible to arrange for the apertures 67A at the upstream ends of the combustion chamber segments 58, 60 to be arranged downstream of the upstream end wall 43 and in proximity to the apertures 47A and 47B so that in operation the flow of coolant through the apertures 47A and 47B creates low static pressure adjacent to the apertures 67A to draw coolant out of the regions 71 of the combustion chamber segments 60 through the apertures 67A. Each aperture 67A at the upstream end of a combustion chamber segment 58, 60 may be aligned circumferentially with and spaced radially from a respective one of the apertures 47A or 47B or each aperture 67A at the upstream end of a combustion chamber segment 58, 60 may be positioned circumferentially between two apertures 47A or 47B and spaced radially from the apertures 47A or 47B. These arrangements may be used with any of the combustion chamber segments used for a rich burn combustion chamber and a lean burn combustion chamber described above. In addition, the upstream end wall 41 has an outer annular flange 41B extending in an axially upstream direction therefrom. The first, upstream, end of the inner wall 66 has a flange 86. The upstream end of the combustion chamber segments 60 are secured to the upstream end wall 44 by one or more bolts passing through the flange 86 and the flange 41B.

Figure 29:
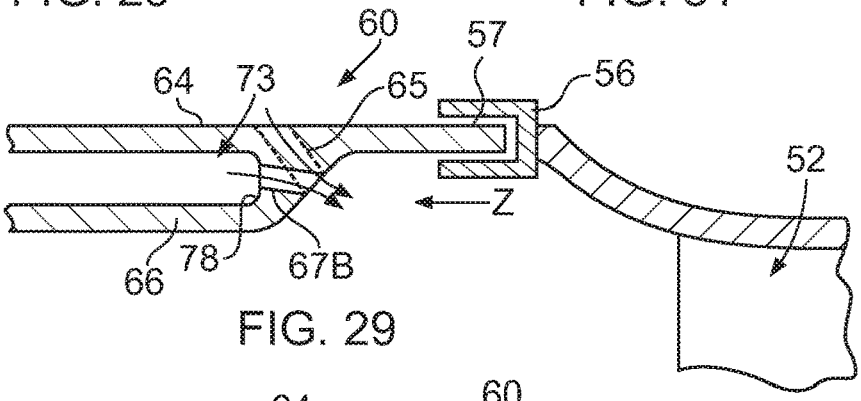
FIG. 29 is an enlarged cross-sectional view of the downstream end of a combustion chamber segment and the downstream end of the combustion chamber.
Figure 30:
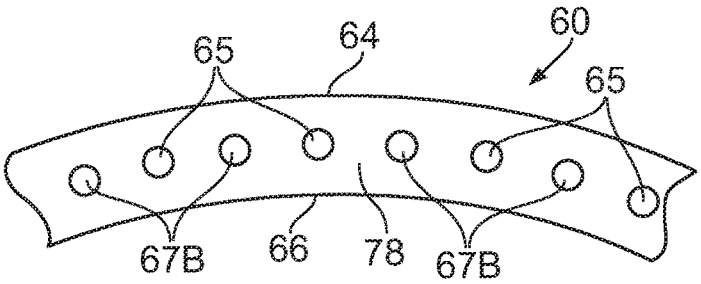
FIG. 30 is a view in the direction of arrow Z in FIG. 29.

An arrangement of the apertures 65 and the apertures 67B at the downstream end of the combustion chamber segments 60 is shown in FIGS. 29 and 30. As mentioned previously a plurality of apertures 65 extend through the downstream end of each combustion chamber segment 58 to provide a film of coolant over the radially outer surfaces of the radially inner platforms of the nozzle guide vanes 52 and a plurality of apertures 65 extend through the downstream end of each combustion chamber segment 60 to provide a film of coolant over the radially inner surfaces of the radially outer platforms of the nozzle guide vanes 52. Each aperture 67B at the downstream end of a combustion chamber segment 58, 60 is provided circumferentially between two circumferentially adjacent apertures 65. The outlets of the apertures 67B and 65 at the downstream ends of the combustion chamber segments 60 are arranged at the same radius and the inlets of the apertures 67B and 65 are at different radii. The outlets of the apertures 67B at the downstream ends of the combustion chamber segments 58 are arranged at the same radius and the inlets of the apertures 67B and 65 are at different radii. Thus, in operation the flow of coolant through the apertures 65 creates low static pressure adjacent to the apertures 67B to draw coolant out of the regions 73 of the combustion chamber segments 58, 60 through the apertures 67B. The flow of coolant through the apertures 67B at the downstream ends of the combustion chamber segments 58, 60 enhances the coolant film created by the apertures 65 on the radially outer and radially inner surfaces of the radially inner and radially outer platforms of the nozzle guide vanes 52. The apertures 67B at the downstream ends of the combustion chamber segments 58, 60 extend through the second end wall 78 and the apertures 65 at the downstream ends of the combustion chamber segments 58, 60 extend through outer wall 64 and the second end wall 78, but the apertures 65 do not extend though the outer wall 64 to inter connect with the interior of the combustion chamber segments 58, 60. Although FIGS. 29 and 30 show only an outer wall 64 downstream of the second end wall 78 it may be equally possible to have an inner wall 66 downstream of the second end wall 78. These arrangements may be used with any of the combustion chamber segments used for a rich burn combustion chamber and a lean burn combustion chamber described above.

Figure 31:
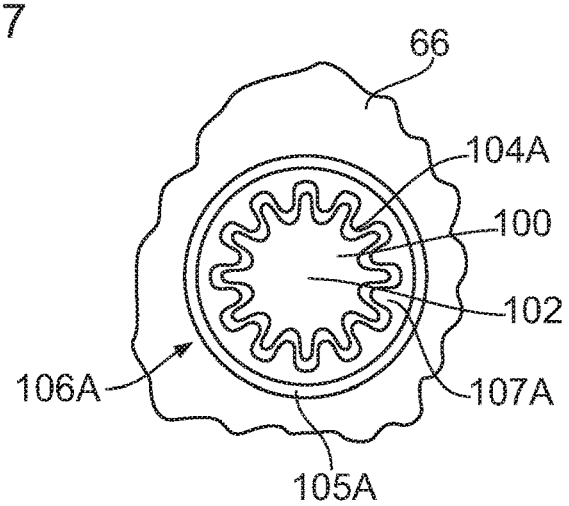
FIG. 31 is view in the direction of arrow R in FIG. 13.

FIG. 31 shows an alternative arrangement of dilution chute 106A which may be used in a combustion chamber segment 58, 60 of any rich burn combustion chamber embodiment of the present disclosure. The dilution chute 106A is similar to that described with reference to FIG. 13 and the dilution chute 106A is double skinned, e.g. is hollow, such that the coolant from the interior of a, or each, region 77 flows through at least one passage 107A within the dilution chute 106A and hence parallel to the flow of dilution air through the dilution chute 106A. The dilution wall 104A forms the inner wall of the dilution chute 106A and an outer wall 105A extends from the inner wall 66 of the combustion chamber segment 58, 60. The at least one passage 107A may be an annular passage or may comprises a plurality of circumferentially spaced slots, arranged through the dilution chute 106A. The flow of dilution air through each of the dilution ports as an ejector to draw, extract, the cooling air from within the respective third region 77 of the box like structure of each combustion chamber segment 58, 60 through the at least one passage 107A within the hollow dilution chute 106A and adjacent to the dilution port and into the combustion chamber. The dilution chute 106A differs in that the inner wall 104A of the dilution chute 106A is corrugated and the corrugations extend generally longitudinally along the inner wall 104A. In particular the outer wall 105A is annular and the inner wall 104A is annular. The outer wall 105A may have a cylindrical inner surface and a cylindrical outer surface. The inner wall 104A has circumferentially spaced longitudinally extending corrugations. This arrangement increases the amount of mixing between the dilution air flowing through the dilution port and the cooling air flowing through the at least one passage 107A. Alternatively, the outer wall 105A of the dilution chute 106A may be corrugated and the corrugations extend generally longitudinally along the outer wall 1054A. The outer wall 105A may have a cylindrical inner surface and a cylindrical outer surface. The inner wall 104A has circumferentially spaced longitudinally extending corrugations. Again this increases the amount of mixing between the dilution air flowing through the dilution port and the cooling air flowing through the at least one passage 107A. It may also be possible to simply provide a single skin dilution chute in which the wall of the dilution chute is corrugated and the corrugations extend generally longitudinally along the wall. The dilution ports, e.g. the dilution apertures, may have other suitable cross-sectional shapes e.g. oval, elliptical or triangular and the dilution walls and dilution chutes have corresponding shapes to define these dilution ports.

An advantage of the present disclosure is that the coolant, air, is taken into the combustion chamber segment, combustion chamber segments or annular wall of the combustion chamber and is ducted towards the upstream end of the combustion chamber within the first region of the interior of each combustion chamber segment, is ducted towards the downstream end of the combustion chamber within the second region of the interior of each combustion chamber segment and in a rich burn combustion chamber is ducted towards the dilution ports of the combustion chamber within the third region of the interior of each combustion chamber segment. The coolant is ducted over the outer surface of the inner wall and picks up heat along the length of the duct, or ducts, due to the longer residence time of the coolant before being exhausted into the combustion chamber as a coolant film over the inner surface of the inner wall, as a coolant film over the platforms of the nozzle guide vanes or in the case of rich burn combustion chamber as additional mixing air. Thus, it is seen that the coolant is used many times, firstly removing heat from the wall by flowing over the outer surface of the inner wall using the coolant's enthalpy, secondly by forming a film of coolant on the inner surface of the inner wall, by forming a film of coolant on the surfaces of the platforms of the nozzle guide vanes or by diluting the combustion process as additional mixing air.

An advantage of the present disclosure compared to a previous arrangement is that it reduces the amount of coolant, e.g. coolant mass flow, required to maintain the combustion chamber wall at a particular temperature or alternatively it reduces the temperature of the combustion chamber wall for a particular amount of coolant, e.g. coolant mass flow. In the former case the coolant, air, may be used for other purposes such as additional coolant for the nozzle guide vanes to increase the working life of the nozzle guide vanes, used in the combustion chamber to reduce emissions of NOx and smoke, increase combustion efficiency or increase specific fuel consumption.

The combustion chamber segments 58, 60, the circumferentially continuous radially inner annular wall structure 440 or the circumferentially continuous radially outer annular wall structure are manufactured by additive layer manufacturing.

The integral box like structure is a single piece structure, e.g. a monolithic structure.

Each combustion chamber segment, or the annular wall of the combustion chamber, comprises an integral structure, e.g. a single piece or monolithic piece, formed by additive layer manufacturing. The outer wall, the inner wall, the upstream end wall, the downstream end wall, the first edge wall and the second edge wall of each combustion chamber segment comprises an integral structure, e.g. a single piece or monolithic piece, formed by additive layer manufacturing. The outer annular wall, the annular inner wall, the upstream end wall and the downstream end wall of the annular wall of the combustion chamber comprises an integral structure, e.g. a single piece or monolithic piece, formed by additive layer manufacturing. The outer wall, the inner wall, the upstream end wall and the downstream end wall of each box like structure comprises an integral structure, e.g. a single piece or monolithic piece, formed by additive layer manufacturing. The apertures in the outer wall, the apertures in the inner wall and any structure or structures, e.g. the wall, or walls, which divide the interior of the combustion chamber segment into a plurality of regions, the walls within the regions which sub divide the regions into a plurality of ducts or the cellular structure, between the inner and outer wall are all formed by the additive layer manufacturing (ALM) process. The additive layer manufacturing process may be direct laser deposition (DLD), selective laser sintering, direct electron beam deposition, laser powder bed etc. The combustion chamber segments, or the annular wall of the combustion chamber, are built using the additive layer manufacturing by initially starting from the upstream end, or the downstream end, of the combustion chamber segment or the annular wall of the combustion chamber. The combustion chamber segment, or the annular wall of the combustion chamber, is built up layer by layer using additive layer manufacturing in the longitudinal, axial, direction of the wall which corresponds to the direction of flow of hot gases over the inner surface of the inner wall. The combustion chamber segments, or the annular wall of the combustion chamber, may be formed from a metal, e.g. a nickel base superalloy, a cobalt base superalloy or an iron base superalloy. The nickel base superalloy may be C263 or CM247LC.

A thermal barrier coating may be provided on the inner surface of the inner wall of the combustion chamber segments or on the inner surface of the inner wall of the annular wall of the combustion chamber. The thermal barrier coating may comprise a ceramic material, for example the ceramic material may comprise zirconia or stabilised zirconia. The thermal barrier coating may be provided on the surface of the inner wall of the combustion chamber segments, or annular wall of the combustion chamber, by plasma spraying, physical vapour deposition, e.g. electron beam physical vapour deposition, or chemical vapour deposition. A bond coating may be provided on the surface of the inner wall of the combustion chamber segments, or the annular wall of the combustion chamber, before the thermal barrier coating. The bond coating may comprise a MCrAlY coating, where M is one or more of nickel, cobalt and iron, or an aluminide coating, e.g. a simple aluminide, a chromium aluminide, a platinum aluminide, platinum chromium aluminide or a silicide aluminide.

The combustion chamber may be an annular combustion chamber comprising two annular walls, an inner annular wall and an outer annular wall, or a tubular combustion chamber comprising a single annular wall. The gas turbine engine may be an aero gas turbine engine, an industrial gas turbine engine, a marine gas turbine engine or an automotive gas turbine engine. The aero gas turbine engine may be a turbofan gas turbine engine, a turbo-shaft gas turbine engine, a turbo-propeller gas turbine engine or a turbojet gas turbine engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber assembly comprising a combustion chamber and a plurality of nozzle guide vanes arranged at a downstream end of the combustion chamber, each nozzle guide vane of the plurality of nozzle guide vanes comprising an inner platform, an outer platform and an aerofoil extending between the inner platform and the outer platform, one of the inner platform and the outer platform having a surface, the combustion chamber comprising a first upstream end wall and at least one annular wall, the at least one annular wall comprising a plurality of circumferentially arranged box like structures, each box like structure of the plurality of circumferentially arranged box like structures extending a full length of the combustion chamber, the each box like structure comprising an upstream end, a downstream end, an inner wall, an outer wall, a second upstream end wall, a downstream end wall, a first edge wall, a second edge wall and an interior, the inner wall being spaced radially from the outer wall, the inner wall having an inner surface, the interior of the each box like structure being divided into at least two regions, the outer wall having a first plurality of apertures for a supply of coolant into each of the at least two regions of the each box like structure, the upstream end of the each box like structure having a second plurality of apertures to supply the coolant from a first upstream region of the interior of the each box like structure and onto the inner surface of the inner wall to form a first film of the coolant, the first upstream region of the interior of the each box like structure being configured to supply at least a portion of the coolant in an upstream direction to the second plurality of apertures at the upstream end of the each box like structure, the downstream end of the each box like structure having a third plurality of apertures to supply the coolant from a second downstream region of the interior of the each box like structure and onto the surface of one of the inner platform and the outer platform to form a second film of the coolant, the second downstream region of the interior of the each box like structure being configured to supply at least a portion of the coolant in a downstream direction to the plurality of apertures at the downstream end of the each box like structure, the outer wall, the inner wall, the second upstream end wall, the downstream end wall, the first edge wall and the second edge wall of the each box like structure comprising an integral monolithic structure, the first upstream end wall has a fourth plurality of apertures to start the first film of the coolant on the inner surface of the inner wall and to draw the coolant out of the first upstream region of the each box like structure, the downstream end of the each box like structure has a fifth plurality of apertures to start the second film of the coolant onto the surface of one of the inner platform and the outer platform and to draw the coolant out of the second downstream region of the each box like structure, inlets of the fifth plurality of apertures are in the outer wall of the each box like structure, and each aperture of the second plurality of apertures at the upstream end of the each box like structure is aligned with an L shaped passage in the first upstream end wall.

2. A combustion chamber assembly as claimed in claim 1 wherein the fourth plurality of apertures in the first upstream end wall are circumferentially spaced apart.

3. A combustion chamber assembly as claimed in claim 2 wherein each aperture of the second plurality of apertures at the upstream end of the each box like structure is arranged circumferentially between two apertures of the fourth plurality of apertures in the first upstream end wall.

4. A combustion chamber assembly as claimed in claim 1 wherein the L shaped passage has a portion arranged parallel to and at the same radius as the fourth plurality of apertures in the first upstream end wall.

5. A combustion chamber assembly as claimed in claim 1 wherein the third plurality of apertures at the downstream end of the each box like structure are circumferentially spaced apart.

6. A combustion chamber assembly as claimed in claim 5 wherein each aperture of the third plurality of apertures at the downstream end of the each box like structure is arranged circumferentially between two of the fifth plurality of apertures at the downstream end of the each box like structure.

7. A combustion chamber assembly as claimed in claim 1 wherein the each box like structure has at least one third region, the at least one third region being positioned between the first upstream region and the second downstream region, each third region of the at least one third region having a dilution port, the inner wall of the each box like structure having at least one passage adjacent the dilution port of each third region of the at least one third region such that the flow of dilution air through the dilution port draws the coolant out of the at least one third region into the combustion chamber as additional mixing air.

8. A combustion chamber assembly as claimed in claim 7 wherein the each box like structure has a plurality of third regions, and each third region of the at least one third region being positioned between the first upstream region and the second downstream region.

9. A combustion chamber assembly as claimed in claim 7 wherein the dilution port comprises a double wall chute, the double wall chute having at least one chamber defined between an inner wall and an outer wall, the at least one passage extending through the at least one chamber between the inner and the outer walls of the double wall chute.

10. A combustion chamber assembly as claimed in claim 7 wherein a height of the interior of the each box like structure in each third region of the at least one third region is greatest adjacent the dilution port.

11. A combustion chamber assembly as claimed in claim 10 wherein a number of apertures per unit length in the outer wall in each third region of the at least one third region decreases towards the dilution port.

12. A combustion chamber assembly as claimed in claim 7 wherein the dilution port is arranged at a centre of the respective third region, the interior of the each box like structure has walls to divide the interior into a plurality of regions, each region of the plurality of regions has further walls to divide the each region into ducts and the further walls extend radially with respect to the dilution port within the third region.

13. A combustion chamber assembly as claimed in claim 12 wherein a cross-sectional area of each duct within the interior of the each box like structure in each third region is greatest adjacent the dilution port.

14. A combustion chamber assembly as claimed in claim 1 wherein the interior of the each box like structure has walls to divide the interior into regions.

15. A combustion chamber assembly as claimed in claim 14 wherein a height of the interior of the each box like structure in the first upstream region is greatest at the upstream end and a height of the interior of the each box like structure in the second downstream region is greatest at the downstream end.

16. A combustion chamber assembly as claimed in claim 15 wherein a number of apertures per unit length in the outer wall in the first upstream region decreases from the downstream end to the upstream end and a number of apertures per unit length in the outer wall in the second downstream region decreases from the upstream end to the downstream end.

17. A combustion chamber assembly as claimed in claim 14 wherein each of the regions has further walls to divide each of the regions into a plurality of ducts.

18. A combustion chamber assembly as claimed in claim 17 wherein the further walls extend axially, longitudinally within the first upstream region and the further walls extend axially, longitudinally, within the second downstream region.

19. A combustion chamber assembly as claimed in claim 18 wherein a cross-sectional area of each duct of the plurality of ducts within the interior of the each box like structure in the first upstream region is greatest at the upstream end and a cross-sectional area of each duct within the interior of the each box like structure in the second downstream region is greatest at the downstream end.

20. A combustion chamber assembly as claimed in claim 1 wherein a plurality of polyhedron shaped chambers are defined by a matrix of integral interconnected walls, the inner wall, the outer wall, the second upstream end wall, the downstream end wall and the matrix of interconnected walls comprise a monolithic piece, the plurality of polyhedron shaped chambers being arranged in at least two layers between the outer wall and the inner wall, at least some of the plurality of polyhedron shaped chambers in each layer of the at least two layers being fluidly interconnected to the plurality of polyhedron shaped chambers in each adjacent layer by a sixth plurality of apertures extending through the integral interconnected walls of the plurality of polyhedron shaped chambers for the flow of the coolant there-between, at least some of the plurality of polyhedron shaped chambers in the layer adjacent the inner wall being fluidly interconnected to define a plurality of ducts extending over an outer surface of the inner wall, the plurality of ducts in the first upstream region extending longitudinally to the second plurality of apertures at the upstream end of the each box like structure and the plurality of ducts in the second downstream region extending longitudinally to the third plurality of apertures at the downstream end of the each box like structure.

21. A combustion chamber segment, the combustion chamber segment extending a full length of the combustion chamber, the combustion chamber segment comprising a box like structure, the box like structure comprising a frame structure, an inner wall and an outer wall, wherein:

the frame structure includes a first end wall, a second end wall, a first edge wall and a second edge wall, the inner wall is spaced from the outer wall, an interior of the box like structure is divided into at least two regions, the outer wall has a first plurality of apertures for a supply of coolant into each of the at least two regions of the box like structure, an upstream end of the at least one box like structure has a second plurality of apertures to supply the coolant from a first upstream region of the interior of the box like structure and onto an inner surface of the inner wall to form a first film of the coolant, the first upstream region of the interior of the box like structure is configured to supply at least a portion of the coolant in an upstream direction to the second plurality of apertures at the upstream end of the box like structure, a downstream end of the at least one box like structure has a third plurality of apertures to supply the coolant from a second downstream region of the interior of the box like structure and onto a surface of one of an inner platform and an outer platform to form a second film of the coolant, the second downstream region of the interior of the box like structure is configured to supply at least a portion of the coolant in a downstream direction to the third plurality of apertures at the downstream end of the box like structure, each aperture of the second plurality of apertures at the upstream end of the box like structure is aligned with an L shaped passage in the first end wall, and the frame structure, the inner wall and the outer wall comprise a monolithic piece.

* * * * *